US007305066B2

(12) United States Patent
Ukita

(10) Patent No.: US 7,305,066 B2
(45) Date of Patent: Dec. 4, 2007

(54) X-RAY GENERATING EQUIPMENT

(75) Inventor: Masaaki Ukita, Kyoto (JP)

(73) Assignee: Shimadzu Corporation, Kyoto-Fu (JP)

( * ) Notice: Subject to any disclaimer, the term of this patent is extended or adjusted under 35 U.S.C. 154(b) by 39 days.

(21) Appl. No.: 10/516,524

(22) PCT Filed: Jul. 17, 2003

(86) PCT No.: PCT/JP03/09122

§ 371 (c)(1),
(2), (4) Date: Dec. 2, 2004

(87) PCT Pub. No.: WO2004/010744

PCT Pub. Date: Jan. 29, 2004

(65) Prior Publication Data

US 2005/0207537 A1 Sep. 22, 2005

(30) Foreign Application Priority Data

Jul. 19, 2002 (JP) ..... 2002-210778

(51) Int. Cl.
*H01J 35/28* (2006.01)

(52) U.S. Cl. ..... 378/126; 378/138; 378/143

(58) Field of Classification Search ..... 378/119, 378/121, 122, 123, 125–129, 131, 138, 143–145, 378/146, 210

See application file for complete search history.

(56) References Cited

U.S. PATENT DOCUMENTS 1,997,676 A * 4/1935 Catlin ..... 378/126
2,133,606 A * 10/1938 Du Mond ..... 378/126
2,926,270 A * 2/1960 Zunick ..... 378/126
3,386,805 A * 6/1968 Figiel ..... 423/461
3,398,307 A * 8/1968 Brown et al. ..... 378/126
3,737,698 A * 6/1973 Carter ..... 378/124
4,399,551 A * 8/1983 Grady ..... 378/126
5,134,640 A * 7/1992 Hirokawa et al. ..... 378/34
5,629,969 A * 5/1997 Koshishiba ..... 378/138
5,631,945 A * 5/1997 Geluk ..... 378/146

(Continued)

FOREIGN PATENT DOCUMENTS

JP 52-110578 A1 9/1977

(Continued)

OTHER PUBLICATIONS

International Search Report for PCT/JP03/09122 mailed on Oct. 28, 2003.

*Primary Examiner*—Edward J. Glick
*Assistant Examiner*—Anastasia S. Midkiff
(74) *Attorney, Agent, or Firm*—Rader, Fishman & Grauer PLLC

(57) ABSTRACT

An X-ray generating apparatus for generating X-rays by irradiating a target with an electron beam. Wherein the apparatus includes a vibration applying means for vibrating the target in directions parallel to a surface thereof. A colliding spot of the electron beam is movable on the target while maintaining an X-ray focus in the same position on the electron beam without fluctuating the X-ray focal position. This enlarges an actual area of electron collision on the target to disperse the generated heat, thereby to suppress a local temperature rise of the target due to the electron collision. The X-ray generating apparatus is compact, and has a long life and a high X-ray intensity.

16 Claims, 16 Drawing Sheets

U.S. PATENT DOCUMENTS

| | | | | |
|---|---|---|---|---|
| 5,892,809 | A * | 4/1999 | Wittry | 378/85 |
| 6,154,521 | A * | 11/2000 | Campbell | 378/125 |
| 6,282,263 | B1 * | 8/2001 | Arndt et al. | 378/138 |
| 6,377,660 | B1 * | 4/2002 | Ukita et al. | 378/143 |
| 6,560,315 | B1 * | 5/2003 | Price et al. | 378/144 |
| 6,792,076 | B2 * | 9/2004 | Petach et al. | 378/119 |
| 7,046,767 | B2 * | 5/2006 | Okada et al. | 378/138 |
| 2002/0101958 | A1 * | 8/2002 | Bertsche | 378/143 |

FOREIGN PATENT DOCUMENTS

| | | | |
|---|---|---|---|
| JP | 04-010342 | A1 | 1/1992 |
| JP | 04-328229 | A1 | 11/1992 |
| JP | 06-188092 | A1 | 7/1994 |
| JP | 09-199291 | A1 | 7/1997 |
| JP | 2000-306533 | A1 | 11/2000 |
| JP | 2001-273860 | A1 | 10/2001 |
| JP | 2002-025484 | A1 | 1/2002 |

* cited by examiner

Fig.1

| | electron beam | | conventional fixed target | | | vibrating target of invention (5μm vibration) | | |
|---|---|---|---|---|---|---|---|---|
| load condition | collision diameter | power | collision area | temperature | life | collision area | temperature | life |
| No. | s[μm] | [W] | S[μm²] | T[K] | [hour] | S[μm²] | T[K] | [hour] |
| 1 | 1 | 0.32W | 0.79 | 2,576 | 142 | 5.79 | 1,140 | 4.7E+27 |
| 2 | 1 | 0.35W | 0.79 | 2,790 | 7 | 5.79 | 1,219 | 1.5E+21 |
| 3 | 1 | 0.86W | 0.79 | 6,417 | (evaporate) | 5.79 | 2,557 | 189 |
| 4 | 1 | 1.0W | 0.79 | 7,413 | (evaporate) | 5.79 | 2,925 | 1.3 |
| | | | | | | (10.79) | (2,217) | (82,381) |
| 5 | 0.1 | 0.24W | 0.0079 | 17,371 | (evaporate) | 0.51 | 2,423 | 169 |
| | | (0.32W) | | | | 1.01 | (2,309) | (1,341) |

X-RAY GENERATING EQUIPMENT

TECHNICAL FIELD

This invention relates to an X-ray generating apparatus for a non-destructive X-ray inspecting system or X-ray analyzing system. One of X-ray generating apparatus is a X-ray tube comprising a cathode with an electron-emissive element and an anode with an anode target plate which are accommodated in an vacuum envelope. More particularly, the invention relates to an apparatus having a very small X-ray source sized in the order of microns to obtain fluoroscopic images of a minute object.

BACKGROUND ART

X-ray generating apparatus of the type noted above are disclosed in Japanese Unexamined Patent Publications 2002-25484, 2001-273860 and 2000-306533, for example.

In these apparatus, electrons (Sa [A]) are emitted from an electron source maintained at a high negative potential (−Sv [V]) in a vacuum. Secondly, the electrons are accelerated by a potential difference between the electron source and ground potential 0V. Thirdly, accelerated electrons are converged to a diameter of 20 to 0.1 μm with an electron lens. Finally, the converged electrons collide against a solid target formed of metal (e.g. tungsten (W), molybdenum (Mo) or copper (Cu)), thereby realizing an X-ray source sized in the order of microns. A maximum energy of generated X-rays is Sv [keV].

An especially high-resolution apparatus among these apparatus is called a transmission X-ray generating apparatus or a transmission X-ray tube. Such an apparatus, for example, has a target with a film thickness of about 5 μm formed on a thin aluminum holder (e.g. 0.5 mm thick plate). X-rays generated at the target are transmitted through the holder, in the direction of incident electron beam, and transmitted X-rays are utilized in the atmosphere. The above holder is called a vacuum window, which is used because the thin target in film form is not strong enough to withstand atmospheric pressure. The vacuum window is clamped tight and fixed to a vacuum vessel by an O-ring or the like. This fixing portion is the center of a forward end of an electron lens, and has an evacuated path with a diameter of about 10 mm for converging and passing the electron beam.

In such a transmission X-ray generating apparatus, the target is disposed very close to the electron lens. As for the primary reason, thereby reducing the influence of aberration of the electron lens, and also the diameter of electron convergence is minimized. Thus a minimum X-ray focus is obtained, and high-resolution X-ray fluoroscopic images are realized. As for another reason, thereby the inspection object is close to the X-ray focus, and thus high magnification images obtain. Such an transmission X-ray tube is used in an inspection apparatus for searching for minute defects in an inspection object. These inspecting operations will sometimes take several hours per object. The conventional apparatus constructed as described above has the following drawbacks.

When accelerated electrons (electrical power Sa·Sv [W]) collide with the target, a large part of the electrical power changes into heat, thereby resulting in an X-ray generating efficiency of 1% or less. The heat generated by the electron collision raises the temperature of an electron-colliding portion of the target. Consequently, the temperature raise evaporates the target material and causes various problems.

Thus, the transmission X-ray generating apparatus is halted at the end of target life. The vacuum window clamped to the vacuum vessel is loosened and turned or changed, so that the electron collision portion is replaced to a new target surface. Subsequently the operation of the apparatus is resumed. This causes a problem that X-rays cannot be generated continuously over a long period of time, or a problem of lowering the operating ratio of the X-ray generating apparatus. Particularly where a large object is inspected, the apparatus is operated with an increased load power in order to increase X-ray intensity. In such a case, the life of the target is short and the X-ray generating apparatus must be halted frequently. Further, there is a limit to the X-ray intensity that can be outputted. Since the microfocus X-ray tube is relatively dark, its working throughput cannot be increased.

A method of trial calculations of a target life from electron beam power and a beam diameter is described hereunder.

When an absorbed electric power (Sv·Sa [W]) collides, within a circle of diameter s [μm], with a surface of semi-infinite solid of thermal conductivity K [W/cm° C.], the steady state temperature rise ΔT [° C.] is expressed as follows (reference: Junzo Ishikawa, "Charged Particle Beam Engineering", Corona Co., May 18, 2001, 1st edition, p145):

$$\Delta T[^\circ\ \mathrm{C.}]=2\times10^{4}\cdot(Sv\cdot Sa)/(\pi \mathrm{K} s) \quad (1)$$

This equation (1) shows that the temperature rise is proportional to the electrical power and is inversely proportional to the collision diameter s. The equation shows also that the temperature rise depends on the electrical power per diameter. Moreover, temperature rise ΔT is inversely proportional to the root of the collision area S, because the collision area S is expressed as $\pi(s/2)^2$. For example, same electrical power and four times area causes half temperature rise.

When the target is formed of tungsten (W), a trial calculation of ΔT is done by using thermal conductivity K=0.9 [W/cm° C.] at the melting point (3,410° C.) of tungsten. And after the trial calculation, the temperature of collision portion in the target at 27° C. (i.e. at room temperature) is given by a equation, T=300+ΔT [K].

Next, a trial calculation of an amount of evaporation d [kg/m$^2$ sec] of the solid at temperature T [K] is done by the following Langmuir equation (2):

$$d=4.37\times10^{-3}\cdot P\sqrt{(M/T)} \quad (2)$$

In this equation, M is the atomic weight of a solid material, and that of tungsten is M=183.8. P[Pa] is the vapor pressure of the solid at the temperature T[K] and is derived from the following equation (3):

$$\log P=-A/T+B+C\log T-DT+2.125 \quad (3)$$

where constants A=44000, B=8.76, C=5 and D=0.

A trial calculation of an amount of evaporation (thickness) per unit time [μm/time] is done by changing the unit of the above amount of evaporation d, thereby dividing by the density of tungsten (19.3 [g/cm$^2$]). Further respecting for a small X-ray focus, the target life is regarded as a time evaporating a thickness corresponding to the collision diameter s.

Results of trial calculations are shown in FIG. 1 under various electron beam conditions and various problems are discussed hereinafter.

Problem 1

"An operating time loss is caused by the target life."

Load condition No. 1 is an example of ordinary use load of the microfocus X-ray tube. An electron beam power 0.32

W collides with a collision diameter s=1 μm, as a result of a calculation, the temperature of the colliding portion is 2,576K and the life is 142 hours.

In this case, the apparatus is stopped every 142 hours for maintenance work, the vacuum window is loosened and is turned to receive the electron beam on a new target surface. Once loosening the vacuum window breaks the vacuum, and the envelope must be evacuated again for about two hour. Then the operation is resumed. Thus, X-rays cannot be generated for about two hours, and hence there is a problem of lowering the operating ratio of the apparatus. Consequently maintenance work has to be done for two hours once a week, and this operating ratio is 142/(142+2)=99% for assuming a continuous operation. In some case the life will be extended by lowering the power, however reducing X-ray intensity and requiring a longer time for fluoroscopy, thereby working throughput will reduce.

Problem 2

"There is an upper limit to X-ray intensity, and no improvement in working throughput."

Load condition No. 2 is an example in which X-ray intensity is slightly higher than the loading condition No. 1. The current is increases by 9% with the same acceleration voltage, and also the electron beam power increases by 9% from 0.32 W to 0.35 W. Thus, X-ray intensity increases by 9% and working throughput also by 9%. However, as a result of a calculation, the temperature of the colliding portion is 2,790K and the life is calculated to be seven hours. In this case, the mere 9% increases in X-ray intensity results to stop the apparatus every seven hours for maintenance work. The operating ratio of the apparatus falls off to 7/(7+2)=78%.

Load conditions No. 3 and No. 4 are examples where X-ray intensity is about three times that of load condition No. 1. As a result of the trial calculations, the temperature of the colliding portion exceeds the fusing point (about 3,680K) and boiling point (about 6,200K) of tungsten. Since the target material evaporates quickly, these conditions are impracticable. If X-ray intensity were increased by three times, working throughput would be three times higher since the time required for generating the same X-ray dosage would be one third. Consequently, there is a limit to load power and an upper limit to X-ray intensity, hence working throughput cannot be improved.

Problem 3

"The tube is darkened by minute focusing."

Temperature rise ΔT is dependent on the electron beam power per diameter as expressed by equation (1). Therefore, when the electron beam is narrowed down to reduce the collision diameter, the the electron beam power must also be reduced. Assume, for example, a case where the collision diameter s=0.1 μm to secure a minute X-ray focus for higher resolution. Since power must be reduced to one tenth in order to obtain the same evaporation rate as in load condition No. 1, X-ray intensity also becomes one tenth and working throughput one tenth. Moreover, since the life is determined by "Further respecting for a small X-ray focus, the target life is regarded as a time evaporating a thickness corresponding to the collision diameter s", the evaporating thickness to the end of life is one tenth, and life is reduced to one tenth, i.e. 14.2 hours. The operating ratio of the apparatus decrease to 14.2/(14.2+2)=88%. Such minute focusing is needed in order to cope with the micro-fabrication of integrated circuits in the semiconductor field today, and therefore is all the more problematic. Load condition No. 5 is a desirable example in which the collision diameter s=0.1 μm and the electrical power is set to 0.24 W which is 75% of the load condition No. 1. As a result of the trial calculations, the temperature of the colliding portion is 1,7371K, and the quick evaporation makes this condition impracticable.

Problem 4

"Caution is needed because of delicate changes in focus shape."

When X-ray irradiation is carried out continuously for 142 hours with the load condition No. 1 in FIG. 1, the target becomes thin as a result of the 1 μm evaporation. During this evaporation, the shape of the target surface struck by the electron beam varies, and the shape and position of the X-ray focus undergo delicate changes. Since a microfocus X-ray apparatus is required to keep high spatial resolution, a fine adjustment of the electron beam is needed even within the lifetime. Therefore, this reduces the operating ratio of the apparatus. Moreover, it should be noted that the life shown in FIG. 1 is tentative and not absolute.

Problem 5

"A thick target unnecessarily absorbs X-rays."

In order to provide a similar X-ray intensity during a life, the target should have a thickness at least equal to a sum of a maximum depth of electron penetration and a thickness corresponding to the target life. Also in order to withstand power increases due to voltage variations or the like, the target usually is formed somewhat thick.

For example, accelerated electrons with an energy of 40 keV at the time of a 40 kV tube voltage collide with the tungsten target and enter the target by a maximum depth of 2.6 μm while generating X-rays of 40 keV or less. Thus, for the 40 kV tube voltage and 1 μm collision diameter, a target thickness of at least 3.6 μm is needed, and a thickness of about 5 μm is adopted to allow for a margin.

However, since the maximum depth of the X-ray generating region is 2.6 μm, only the X-rays not absorbed by the remaining 2.4 μm of the target thickness of 5 μm is used as transmitted X-rays. This constitutes a low utilization rate of the generated X-rays. Where, for example, X-rays of 20 KeV pass through the tungsten of 2.4 μm, only 80% is transmitted. Thus, X-ray intensity is low and the working throughput falls off to 80%.

Problem 6

"A rotating anode X-ray tube is incapable of high resolution."

To solve the problem caused by the heat of the target, an X-ray generating apparatus of millimeter-size focus for medical use employs the rotating anode type. However, rotational accuracy is insufficient with a bearing (ball bearing) used for rotation, and the anode target is not rotated with high accuracy, then the X-ray focus is blurred. Therefore the rotating target is difficult to apply particularly to the microfocus X-ray generating apparatus having an X-ray focal size in the order of microns. The above problem is discussed more particularly hereinafter.

The rotating anode X-ray tube has an X-ray focal size in the order of 0.2 to 1 mm, and has a vacuum vessel, an electron source, an anode disk, a rotating bearing and a motor formed as an integrated unit. But the motor is spaced from the electron beam, because the motor generating an electromagnetic force deflects the electron beam unnecessarily. Thus, the rotating anode X-ray tube tends to be large. Further, a ball bearing is employed as the rotating part and has an inside diameter of 6 to 10 mm, an outside diameter of 10 to 30 mm or more, and a thickness of 2.5 to 10 mm or more. The highest accuracy class of ball bearings in this range of sizes is specified in Class 2 of the Japanese Industrial Standards, and the axial deflection accuracy and radial deflection accuracy of the inner ring are as much as a maximum of 1.5 μm. Since the X-ray tube is used in severe conditions of high vacuum, high temperature and high speed, a special lubricating system is used. The degree of vacuum inside the X-ray tube, for example, has to be 0.13 mPa ($10^{-6}$ Torr) or less. The bearing is operable in the temperature range of 200 to 500° C. due to the generating heat of the anode, and a high-speed rotation in the order of 3,000 to 10,000 rpm (50 to 167 cyc/sec) is also required. In order to satisfy such severe conditions, the X-ray tube employs a very special bearing using a thin coating of soft metal as solid lubricant. However, since the life of the solid lubricant is short, the life of the rotating anode X-ray tube also has a life of only several hundred hours.

The microfocus X-ray tube has a lower load power than the X-ray tube for medical, therefore the target holder does not reach such a high temperature. However, bearing steel has a coefficient of linear thermal expansion in the order of $12.5\times10^{-6}$ (1/° C.), and a temperature rise of only 20° C. lowers its rotational accuracy with the inside diameter expansion of 1.5 to 2.5 μm. A temperature rise of about 20° C. easily occurs with a change in a room temperature or with a heat generated by rotation friction. Combined with the rotational accuracy specified in Class 2 of the JIS, a rotational accuracy of 3 μm or less is unwarranted and impracticable. Further, the rotating anode disk have a diameter of 10 mm or larger because of the outside diameter of the bearing, and the whole waviness of the target surface, since tungsten is extremely hard and difficult to shape, varies the X-ray focal position by about 10 μm. Accuracy of this level is not problematic with the medical X-ray tube whose X-ray focal size is about 0.2 to 1 mm. However, with the microfocus X-ray tube whose X-ray focal size is in the order of microns, focal size variations and focal position shift in the electron beam directions make the application of the rotating anode type difficult.

The bearing is at least five times thicker than the transmitted X-ray type vacuum window which is about 0.5 mm thick, whereby the rotating anode type has to be large. The rotating anode requires a vacuum window as an essential component for acquiring X-rays. That is, the rotating anode and an object under inspection cannot be brought close to each other, and it is accordingly difficult to increase geometric magnification. Even if a high-accuracy ball bearing is developed, it will be difficult to obtain high-resolution X-ray fluoroscopic images.

DISCLOSURE OF THE INVENTION

This invention has been made having regard to the state of the art noted above, and its object is to provide an X-ray generating apparatus with high resolution and compactness, for extending the life of a target, increasing the operating ratio of the apparatus, extending a time of continuously generating X-rays, and improving X-ray intensity.

The above object is fulfilled, according to this invention, by an apparatus for generating X-rays by irradiating a target with an electron beam, comprising a vibration applying means for vibrating the target in directions parallel to a surface thereof.

The vibration applying means vibrates the target in directions parallel to the surface thereof. Whether the apparatus is the transmission type or reflection type, a colliding spot of the electron beam is moved on the target surface while maintaining an X-ray focus in the same position on the optical axis of the electron beam without fluctuating the X-ray focal position. This enlarges an actual area of electron collision, disperses the generating heat, thereby suppress a local temperature rise due to the electron collision. Thus, evaporation of the target is suppressed. As a result, the target is given an extended life, to increase the operating ratio of the apparatus resulting from changing and adjustment of the target. Moreover, X-ray intensity also increase.

The vibration in this invention is a shaking motion in substantially fixed cycles, having functions and effects not acquired simply by rotating the target.

That is, by rotation, the electron beam will repeatedly move along the same track on the target. By vibration, on the other hand, the electron beam is not only moved on the same track, but, for example, is vibrated to describe the same track in a first area on the target, and after a predetermined time the electron beam is moved to a second area and vibrated to describe the same track therein. With such vibration, the electron beam can be moved on different tracks on the target, to increase a more actual area of electron collision. Compared with the rotation type describing a fixed track, thus using only part of the target, the vibration type can make effective use of the entire surface of the target by setting various tracks of the electron beam on the target surface.

Conversely, the area of the target is reduced so that the target is small and lightweight, and that the vibration applying device also is reduced in size. Thus, the X-ray focus and an object under inspection are brought close to each other to obtain high-resolution X-ray fluoroscopic images with geometrically increased magnification.

The vibration herein has a wide range of cycles including every several months, several weeks, several days, several hours, several Hz, several kHz and several MHz.

Preferably, the vibration applying means is arranged to vibrate the target so that the electron beam has a colliding spot describing, on the target, a linear track, a circular track, or a two-dimensional shape including zigzag and rectangular shapes.

By vibrating the target so that the electron beam describes, on the target, a one-dimensional shape such as circular arc or a straight line, or a two-dimensional shape such as a zigzag, rectangular or square shape, vibration applying means is effected relatively easily and enlarge the effective area of electron collision. A two-dimensional track in particular allows the target to be especially small and the vibration applying device also to be small.

The apparatus according to this invention, preferably, further comprises a vibration controller for controlling the vibration applying means. A vibration is controlled in one of a tube voltage, a tube current, an electron beam diameter, and a temperature measured adjacent a spot of electron beam collision.

A temperature rise of the target is proportional to a tube voltage and a tube current, and inversely proportional to a diameter of electron beam collision. Thus, suitable vibration is applied by controlling the holder of the target based on these factors.

Preferably, the vibration controller is arranged to control the vibration amplitude more than the electron beam diameter.

By vibrating the target with an amplitude at least corresponding to the electron beam diameter, no part of the target is constantly irradiated by the electron beam, thereby a temperature rise is uniform. It is still more desirable to control the vibration to have an amplitude at least twice the electron beam diameter. Furthermore, increasing vibration amplitude decreases the temperature rise of the part of electron beam collision. The vibration amplitude is arranged in proportion to the electron beam power or inversely proportion to the electron beam diameter.

Preferably, the vibration controller is arranged to make a frequency of vibration variable.

Increasing vibration frequency makes the uniform heat distribution of the area of electron beam collision, thereby suppresses a partial temperature rise. The vibration frequency is arranged in proportion to the electron beam power or inversely proportion to the electron beam diameter.

The vibration applying means, preferably, includes a piezoelectric device.

A piezoelectric device does not produce a magnetic field, and therefore has no adverse influence on the electron beam. A piezoelectric device is operable at high speed and capable of minute displacement in the order of microns. Thus, a piezoelectric device is well suited to the vibration applying device.

Preferably, the piezoelectric device is integrated with a holder and target to make a closed space.

A vacuum window is no longer needed for maintaining the target surface in a vacuum, to simply the tube construction. Further, since the vacuum window is unnecessary, the distance between the X-ray focus and inspection object is minimized to enable high-resolution X-ray fluoroscopy with geometrically increased magnification.

Preferably, the apparatus according to the invention further comprises flexures for attaching and supporting the holder.

The heat generated in the target is transfer away by heat conduction of the flexures, thereby suppressing a temperature rise of the entire target. Furthermore, since a deflection of the target in a direction along the electron beam is reduced, the vibration is applied in the directions parallel to the target surface and then suppresses deviation of the X-ray focus.

Preferably, the flexures are made by electrical discharge machining.

Electrical discharge machining assures high dimensional accuracy, and processes a thin metal flexure in the deep metal plate. Thus, the flexure have a high aspect ratio and is formed integrally on the holder. The flexures do not deflect the target surface from the collision spot of electron beam, and a precise vibration is possible. Furthermore its heat conduction loss is minimized and the target temperature decreases.

Preferably, the target is vacuum-sealed by rubber elements or flexures.

Since vibration is applied to the holder, rubber elements or flexures, or both in combination, are used between the holder and the fixed vacuum vessel to absorb the vibration of the holder and target. In this way, a vacuum seal is provided for the target surface. Thus, there is no need for a separate vacuum window, to minimize a distance between the X-ray focus and inspection object, and to enable high-resolution X-ray fluoroscopy with geometrically large magnification.

Preferably, the target has a thickness up to twice depth of electrons penetration calculated from a tube voltage and target materials.

The vibration applying means extends the target life, then it makes a thick target unnecessary and realizes a minimum thickness target. This thickness approximately corresponds to depth of electrons penetration calculated from the tube voltage and target materials, but preferably at most not exceeding twice the calculated depth. With this thickness, the unnecessary X-ray absorption is minimized to make efficient use of generated X-rays. This is advantageous particularly when easily absorbable soft X-rays are used.

Preferably, the vibration controller is arranged to displace the target when the electron beam applies a small load to the target.

When the electron beam applies a small load to the target so that the target lasts at least several hours or several days without being vibrated, the vibration controller displaces the target only a distance corresponding to at least several times the diameter of electron beam collision, and then keeps the target still. Thus, the spot of electron beam collision on the target is renewed only by displacement. The spot of electron beam collision is moved to a different position on this target within a much shorter time than on a fixed target, thereby eliminating a loss in operating time. The target will or will not be vibrated in each position.

Preferably, the vibration applying means is disposed in an opening in which the target is located.

Because aberration of electron lens is as small as close to the lens, an electron beam convergent diameter is smaller near the lens. Thus the minimum X-ray focus is obtained when the target is in the opening of the lens. Furthermore, the vibration applying means locates in the opening, the compactness enables the X-ray focus and object to be close and raise photographic magnification, thereby realizing X-ray fluoroscopy with high spatial resolution.

Preferably, the flexures are shaped thin in a direction of vibration of the target, and thick in a direction perpendicular to the direction of vibration.

The flexures have a high aspect ratio and are driven in the direction of vibration with a small force, but are difficult to move in the direction perpendicular to the direction of vibration. Thus, the target is vibrated with high precision without deflection in the direction along the electron beam.

Preferably, the target is disposed at an angle to the electron beam.

A reflection X-ray generating apparatus, as does a transmission X-ray apparatus, produces a similar thermal effect to realize a long life and high X-ray intensity.

BRIEF DESCRIPTION OF THE DRAWINGS

FIG. 1 is a table showing results of trial calculations made on various electron beam load conditions regarding the life of a target formed of tungsten;

FIG. 10 shows a construction of a vibration unit, in which

FIG. 11 shows a different construction of the vibration unit, in which

FIG. 12 shows a different construction of the vibration unit, in which

FIG. 13 shows a different construction of the vibration unit, in which

FIG. 14 shows a different construction of the vibration unit, in which

FIG. 15 shows a construction of a cylindrical piezoelectric device, in which

FIG. 16 shows a different construction of the vibration unit, in which

BEST MODE FOR CARRYING OUT THE INVENTION

Figure 2:
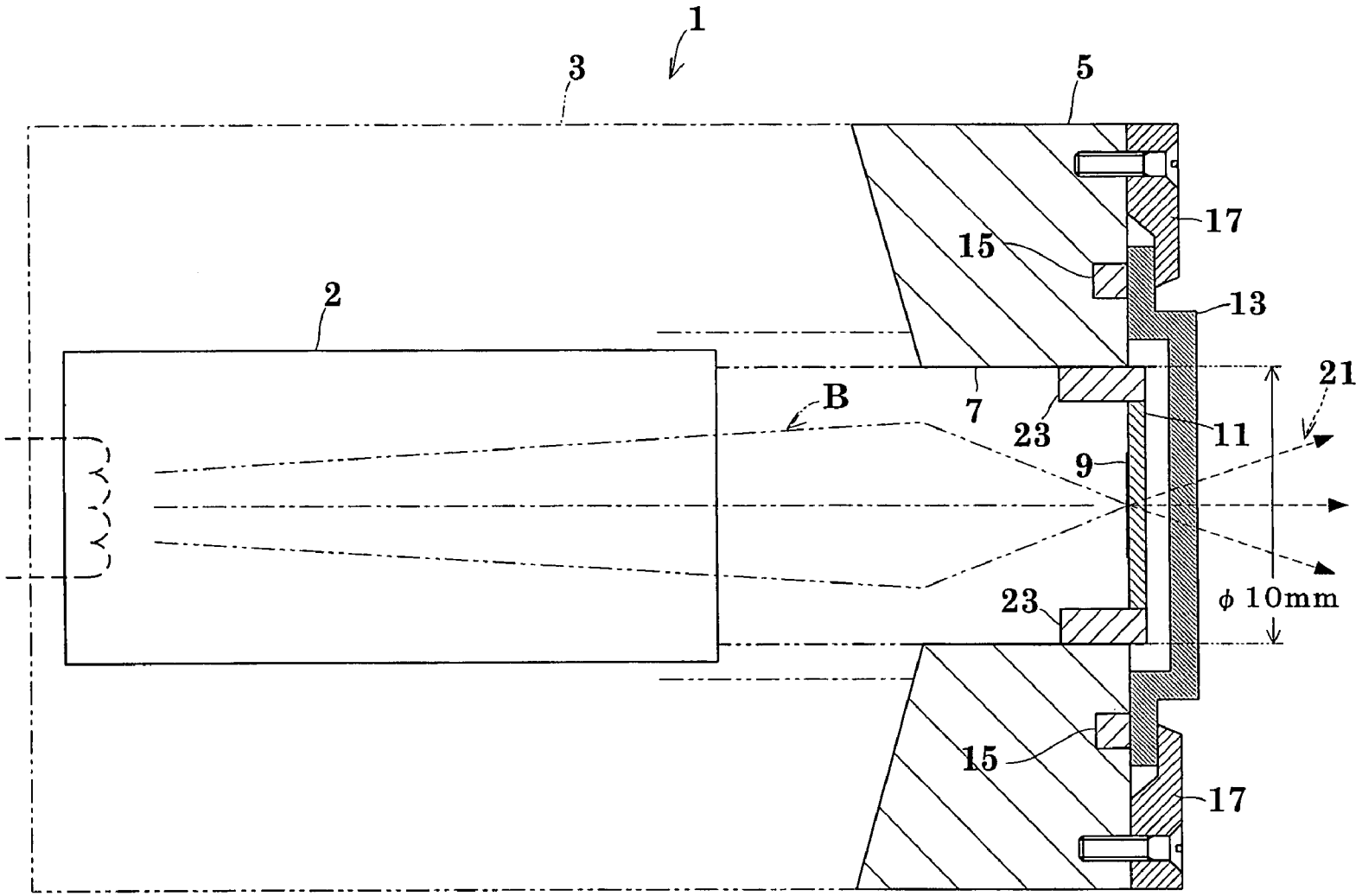
FIG. 2 is a cross section showing an outline of an X-ray tube.
Figure 3:
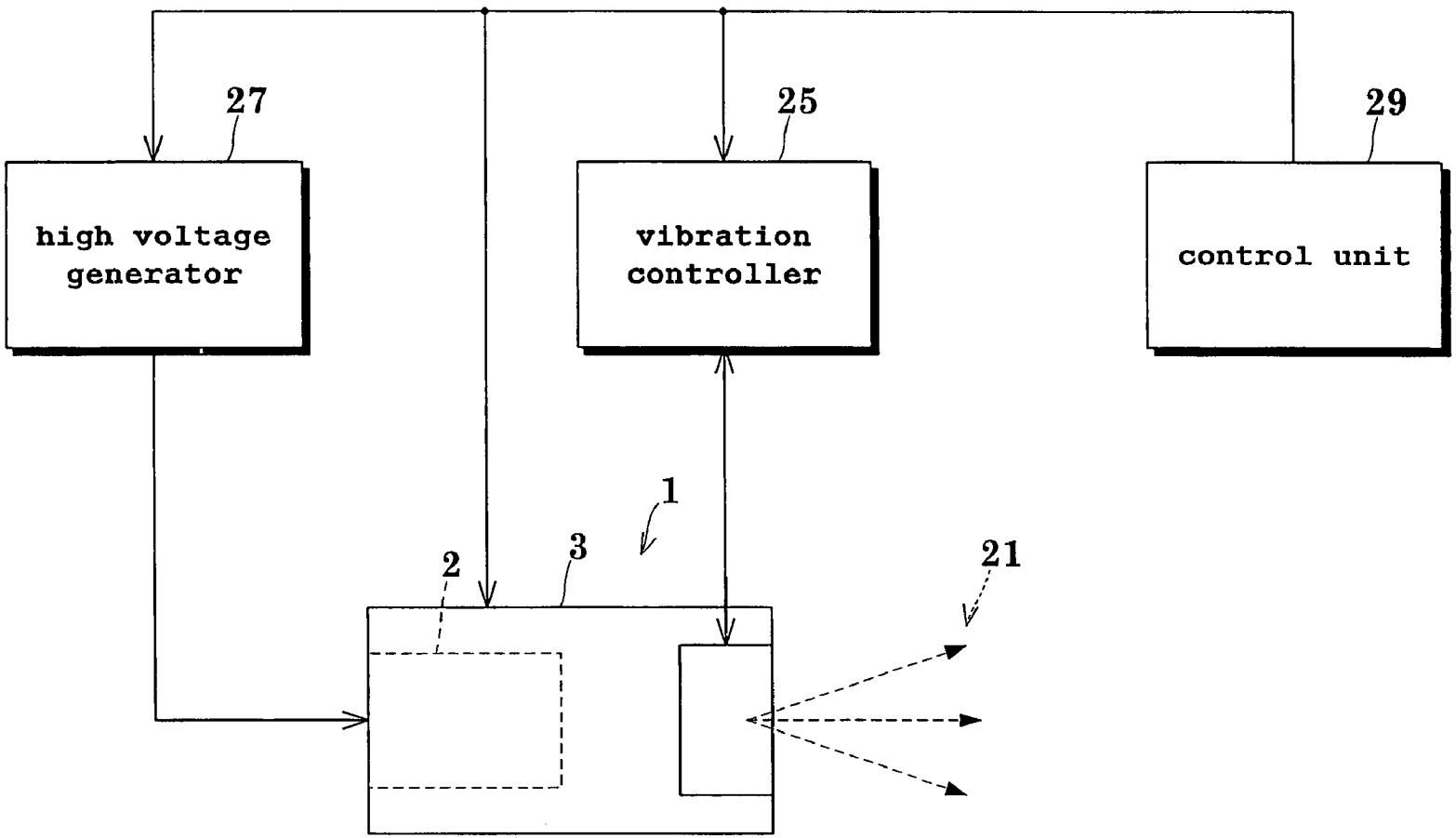
FIG. 3 is a block diagram showing an outline of an X-ray generating system.
Figure 4:
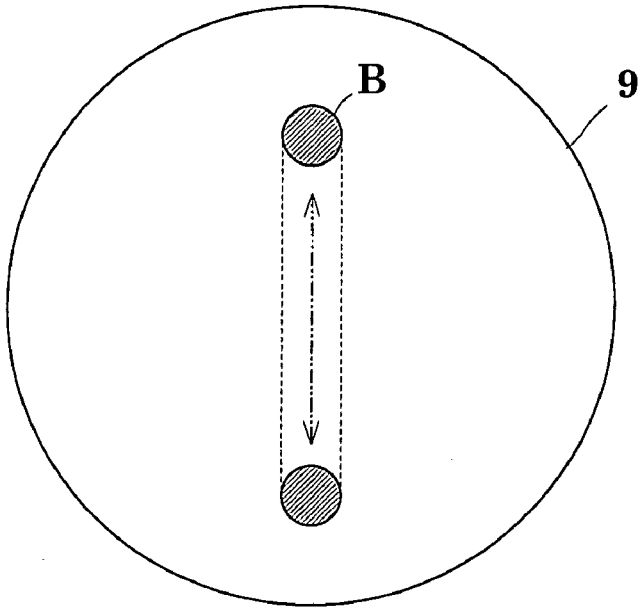
FIG. 4 is a schematic drawing showing a vibration track of an electron beam on a target.
Figure 5:
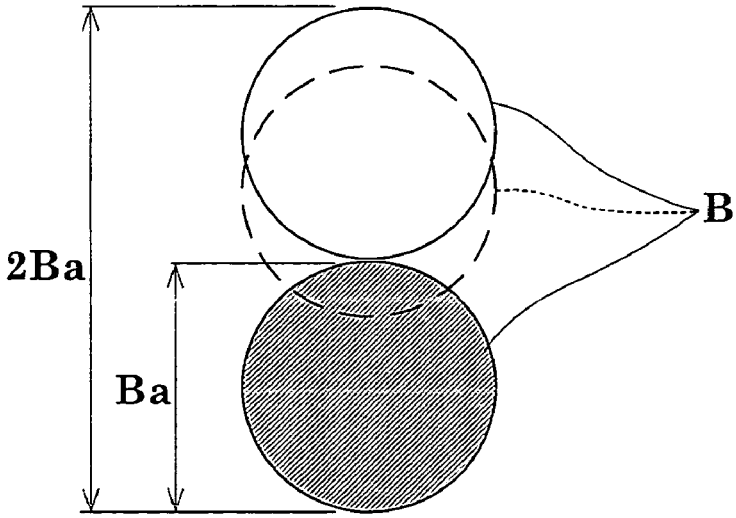
FIG. 5 is an enlarged schematic drawing showing areas of electron beam collision.

Modes for solving the problem of the prior art include the following:

FIGS. 2 through 5 show one embodiment of this invention. FIG. 2 is a cross section showing a transmission X-ray tube. FIG. 3 is a block diagram showing an outline of an X-ray generating system. FIG. 4 is a schematic drawing showing vibration of an electron beam on a target surface. FIG. 5 is an enlarged schematic drawing showing areas of electron beam collision.

A transmission X-ray tube 1 has an electron gun 2 mounted in a vacuum vessel 3 for generating an electron beam B. The vacuum vessel 3 has an X-ray generating portion, shown in enlargement, opposed to the electron gun 2. The X-ray generating portion includes an end block 5 that is a part of pole pieces of an electron lens. The end block 5 has the bore 7 that is formed centrally, and the bore 7 is a diameter of 10 mm or less. A target 9 is attached to a holder 11 fitted in the bore 7. The target 9 is made from metal such as tungsten or molybdenum to generate X-rays when irradiated with an electron beam. A vacuum window 13 is disposed adjacent the holder 11. The vacuum window 13 is clamped by a mount ring 17 screwed to the end block 5, and the vacuum window 13 serves as a vacuum lock in combination with an O-ring 15 embedded around the bore 7. The holder 11 and vacuum window 13 are made from a material such as aluminum that transmits X-rays well. The wall thickness of vacuum window 13 is in the order of 0.5 mm and is strong enough to maintain the vacuum against atmospheric pressure.

In the transmission X-ray tube 1, the electron beam B emitted from the electron gun 2 is converged adjacent the electron lens pole piece of end block 5 to irradiate the target 9. X-rays are generated from the target 9 irradiated with the electron beam B, and are transmitted through the holder 11 and vacuum window 13 to emerge as irradiating X-rays 21. With use of an electron lens optical system, an electron converging position is shiftable along a beam axis to vary a diameter of electron collision on the target 9. It is thus possible to vary an X-ray focal size also. When the lens is adjusted so that the converging point is on the target surface, a minimum X-ray focus dependent on the aberration of the electron lens is obtained. Although the electron convergence depends on the type and arrangement of the electron lens, an electron convergence diameter in the order of nanometers can be obtained by an electronic optical system such a SEM. Further, since an electron convergence diameter in the order of 5 to 100 μm is obtained with an electron gun only having an electrostatic lens, a construction without a special electron lens is also conceivable. Furthermore, various tube constructions is considered depending on inspection objects and purposes.

In this embodiment, the target 9 is vibrated by vibrating the holder 11 with a vibration unit 23 disposed on the inner peripheral surface of the bore 7 in the end block 5. The vibration is applied in directions parallel to the surface of the target 9 so that the X-ray focus position is fixed during an electron beam irradiation. In this embodiment, the electron beam is at right angles with the target surface, and thus the target 9 vibrates in perpendicular to the electron beam. However, this perpendicular relationship is not essential in this invention.

The vibration unit 23, which corresponds to the vibration applying means of this invention, is controlled by the vibration controller 25 shown in FIG. 3. The vibration controller 25 controls an amplitude, frequency and so on of vibration of the target. A tube voltage, tube current and so on applied to the electron gun 2 are controlled by a high voltage generator 27. The vibration controller 25 and high voltage generator 27 are controlled by a control unit 29 operable on instructions given by the operator.

The vibration unit 23 vibrates the holder 11 and the target 9 linearly, so that a colliding spot of electron beam B reciprocates linearly on the surface of the target 9. In this case the colliding spot is on a linear track as shown in FIG. 4, but the X-ray focus do not move.

As shown in FIG. 5, the vibration amplitude is desirably more than the diameter Ba of electron beam B. By controlling the vibration in this way, no steady duplication of electron beam B occurs in time of vibration, to provide an advantage of uniformly suppressing a temperature rise in areas of electron beam collision.

Next description shows that this embodiment improves the problems 1-4 noted in the conventional example described hereinbefore. A plurality of characteristic examples of the vibration applying means embodying this invention is described later herein. This order of description is adopted for the following reasons. Minute vibrations occur very easily and infinite embodiments are possible, but are too numerous to describe. To describe certain specific embodiments could be misleading. For example, vibrations in the order of microns commonly occur in nature, and experience shows that a target could be vibrated by a slight propagation of motor vibration. In the field of patent, vibration isolating mechanisms is more meaningful than vibration mechanisms. Further, a specific basic component such as a ball bearing used in a rotating mechanism is not conceivable for minute vibration as in this invention.

Trial calculations are executed to determine degrees of improvement in load conditions No. 1-4 in FIG. 1. When the electron beam B collides with a conventional fixed target, the collision area S is $\pi(0.5)^2=0.79$ [$\mu m^2$]. On the other hand, when the target 9 vibrates with a amplitude of 5 μm as an example vibration in this invention, a total collision area S of the electron beam is $(\pi(0.5)^2+1\times5)=5.79$ [$\mu m^2$]. Therefore, the collision area S becomes 5.79/0.79=7.3 times large, and S is converted into a circle of a diameter s 2.7 μm. Temperature rise ΔT derived from equation (1) is 1/2.7 of the fixed target. The evaporation of tungsten derived from equations (2) and (3) reduces, and thus target life is extended. Results of the trial calculations of the life are shown in the column "vibrating target" in FIG. 1. The degrees of improvement are described hereunder.

Improvement regarding problem 1: "The operating time loss is eliminated by a extremely long life."

Load condition No. 1 is an example of ordinary use load of a microfocus X-ray tube. With this load condition No. 1, compared with the life of 142 hours of the fixed target, the life according to this invention is improved to $4.7\times10^{27}$ hours, which is regarded as an infinite life. The operating ratio of the apparatus is improved to 100%. The weekly two hours' maintenance is no longer necessary.

Improvement regarding problem 2: "X-ray intensity increases, and so does working throughput."

Load condition No. 2 is an example in which X-ray intensity is slightly higher than in condition No. 1, and trial calculations are executed with the power increased by 9% from 0.32 W to 0.35 W. With this load condition No. 2, compared with the life of seven hours of the fixed target, the life according to this invention is improved to $1.5\times10^{21}$ hours, which is regarded as an infinite life. The operating ratio of the apparatus is improved from 78% to 100%. The two hours' maintenance carried out every seven hours is no longer necessary. The 9% increase in working throughput due to the 9% increase in X-ray intensity over the load condition No. 1 for the fixed target is retained intact, to allow an inspecting operation of 9% increase.

Load condition No. 3 is an example where X-ray intensity is about 2.7 times strong compared with the load condition No. 1. This condition is impracticable with the fixed target. The life according to this invention is greatly improved to 189 hours. Compared with load condition No. 1 for the fixed target, the invention achieves an improvement in life of 189 hours/142 hours=1.3 times, an improvement in X-ray intensity of 0.86 W/0.32 W=2.7 times, and an improvement in working throughput of 2.7 times.

Load condition No. 4 is an example where X-ray intensity is about 3.1 times that of load condition No. 1. This condition is impracticable with the fixed target. The life according to this invention is no less than 78 minutes. The invention provides an improvement in working throughput of 3.1 times over the fixed target under load condition No. 1.

The above improvements in load conditions No. 1-4 are achieved where the target is vibrated by 5 μm as one example according to this invention. However, the life improved under load conditions No. 3 and 4 may be considered still short. This invention, therefore, utilizes the fact that vibrating amplitude is varied easily. Further results of trial calculations for vibration in 10 μm are supplemented in parentheses in FIG. 1. In this further case, even with load condition No. 4, the trial calculations show a temperature of the colliding portion=2,217 K, and the life=82,381 hours which is sufficiently long. That is, this invention readily realizes an X-ray intensity increased by three times or more and a long life, thereby significantly improving working throughput.

Improvement regarding problem 3: "The tube is not darkened by minute focusing."

Load condition No. 5 in FIG. 1 shows a improvement example of this invention which is applied to the minute focal size needed in order to follow the micro-fabrication of integrated circuits in the semiconductor field today. In the load condition No. 5 in FIG. 1, the diameter of electronic collision is 0.1 μm. With the conventional fixed target, an inspection has to be conducted with X-ray intensity lowered to 0.032 W, i.e. a one-tenth of the load condition No. 1. When, despite this, the load is increased to 0.24 W as in load condition No. 5, the fixed target has no life. However the vibration target with amplitude of 5 μm has the life of 169 hours, which is an improvement to practice the condition No. 5. This is no less than 20% longer than the life of 142 hours of the conventional fixed target under load condition No. 1. The X-ray intensity also is no less than 75% of that in load condition No. 1.

However, it may be felt that intensity is insufficient in the improvement of load condition No. 5. Further results of trial calculations for vibration in 10 μm with the same intensity as in load condition No. 1 (power of 0.32 W) are supplemented in parentheses in FIG. 1. The life is improved to 1,341 hours, which is sufficiently long. That is, according to this invention, the minute focusing does not make the tube dark. Thus, a more detailed inspection can be conducted, without reducing working throughput, which is well fit for inspection of advanced minute semiconductors.

Improvement regarding problem 4: "Use is facilitated by only slight variations in focal configuration."

Conventionally, a microfocus X-ray tube do not keep high spatial resolution without a fine adjustment of the focal position even within a lifetime. However, as noted in relation to the improvement made with respect to problem 1, a life comparison under load condition No. 1 in FIG. 1 shows substantial improvements of this problem. The invention provides a life of $4.7\times10^{27}$ hours, which is regarded as an infinite life and an improvement over the 142 hours life of the fixed target. After a use period of 100,000 hours, the vibration target evaporates by a thickness of only $2\times10^{-19}$ μm. This poses no problem for the 1 μm diameter of collision. Thus, a high spatial resolution is maintained without adjustment, thereby the tube is easy to use.

As described above, problems No. 1-4 of the conventional example are significantly improved by this invention defined in claim 1. These improvements have been described mainly in FIG. 1. In these trial calculations, all the areas of electron collision due to the vibration are defined as a linear track as shown in FIG. 4. FIG. 6 through FIG. 9 illustrate other tracks of electron collision spot (claim 2).

Figure 6:
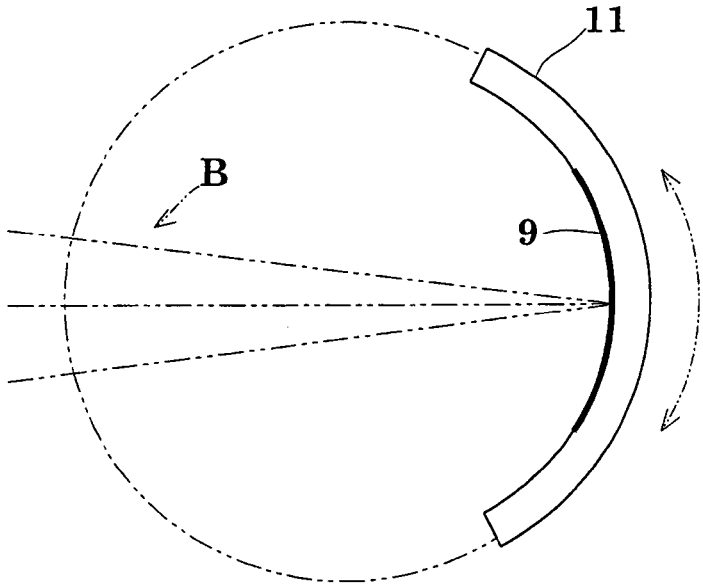
FIG. 6 is a schematic drawing showing a different track of the electron beam on the target.
Figure 7:
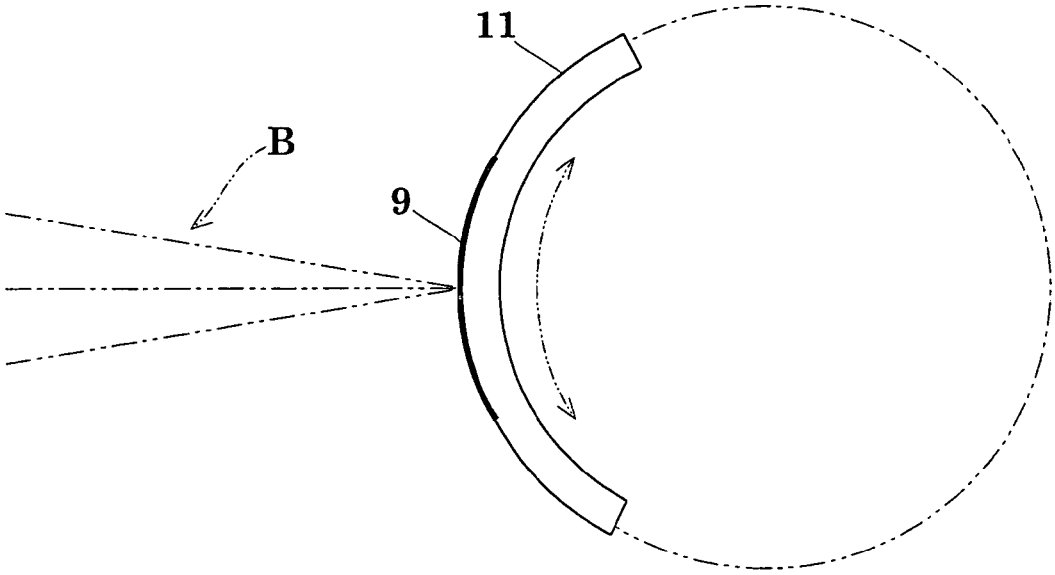
FIG. 7 is a schematic drawing showing a further different track of the electron beam on the target.

FIG. 6 and FIG. 7 show examples that the target 9 is a arcuate shape in side view. These targets are swung accurately around a virtual circle containing arcuate target, and X-ray focus is on steady position.

Figure 8:
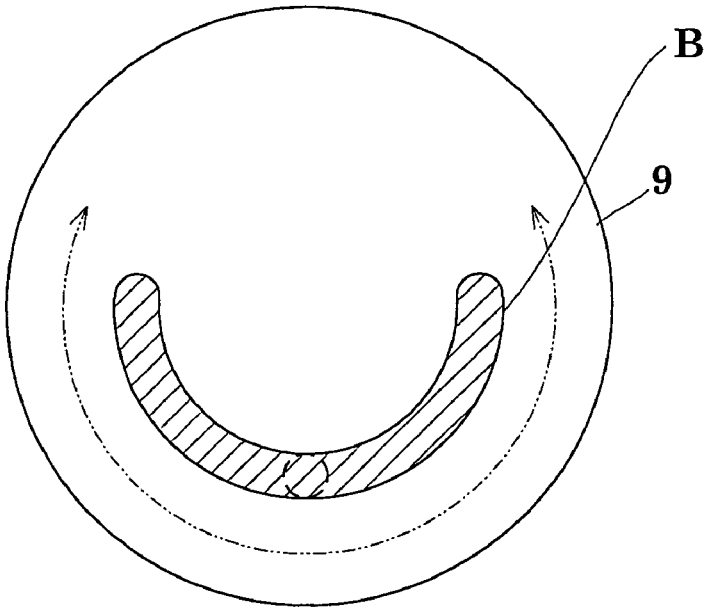
FIG. 8 is a schematic drawing showing a further different track of the electron beam on the target.

FIG. 8 shows an example where the holder 11 is swung so that the electron beam B describes an arcuate track on the surface of target 9. In this case, the holder 11 will be driven by a ring-like ultrasonic motor to rotate back and forth to vibrate the target 9 arcuately as indicated by a two-dot chain line arrow. Instead of the ultrasonic motor, an electrostatic motor will be used to apply vibration.

Figure 9:
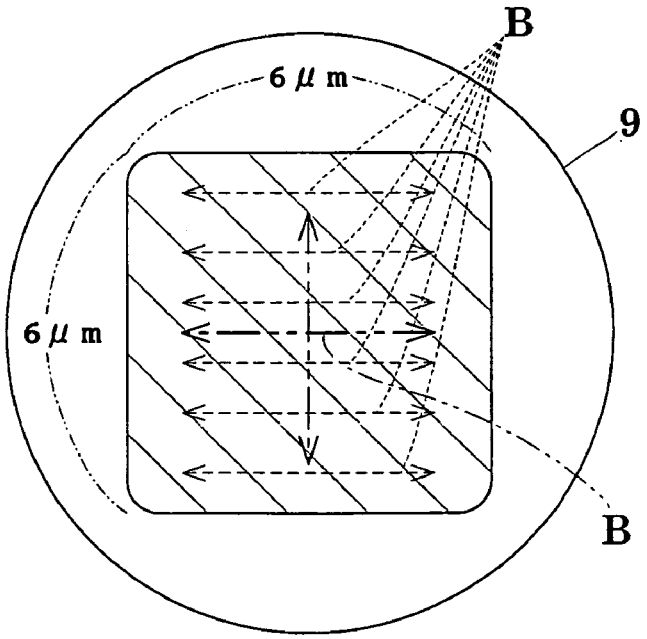
FIG. 9 is a schematic drawing showing different tracks of the electron beam on the target.

FIG. 9 shows an example where the holder 11 is vibrated two-dimensionally as indicated by two-dot chain line arrows, to provide an electron collision area of 6 μm square. The holder 11 is vibrated right and left while vertically shifting at predetermined intervals so that the electron beam B describes different sideways tracks as indicated by dotted lines in FIG. 9. Where each of the two sides of the two-dimensional vibration is 6 μm long and the diameter of electron beam collision s=1 μm, the area is six times that of the linear track such as in FIG. 4. The temperature rise on the target surface derived from equation (1) is $1/\sqrt{6}$, which provides an advantage of further extending the life. In addition, the target surface is used fully and effectively. Conversely, the above embodiment minimizes the target size and the holder weight. As a result, the vibration power is a minimum to produce a remarkable effect of minimizing the vibration unit. As an additional example, the target 9 is vibrated zigzag.

Next, examples of control by the vibration controller 25 is described.

The vibration controller 25 said in claim 3, controls vibration amplitude Vw [μm] and vibration frequency Vf [Hz] to be optimal, according to a diameter of collision s [μm] of electron beam B, tube voltage −Sv [V] or tube current Sa [A] set by the control unit 29. Alternatively, measuring a temperature adjacent the electron beam collision spot controls the vibration.

A normal tube current Sa have a value proportional to a set value. Preferably, vibration control is based on a signal from an ammeter (not shown) measuring the target current directly.

The controls are effected such that the higher the temperature measured adjacent the spot of electron beam collision, the smaller the collision diameter s, or the greater the electrical power, the greater the vibrating amplitude and frequency are.

As an example said in claim 4, the control of "vibration amplitude", preferably, is based on the following equation (5):

$$Vw=\alpha\cdot(Sv\cdot Sa)/s \quad (5)$$

Where, for example, the amplitude is 5 μm which is effective for the improvements relating to problems 1-4, coefficient α, preferably, is 5 to 15. However, it is desirable to change coefficient α appropriately according to the heat conductivity K, load, life and so on of the target material.

However, when coefficient α=5, electrical power=1 W and diameter of the collision s=5 μm, for example, the vibrating amplitude Vw is 1 μm. This means that the electron beam B constantly strikes a target portion. In order to avoid this situation, it is desirable to determine from the following condition formula after calculation of equation (4):

"Condition Formula"

When vibrating amplitude Vw<collision diameter s, vibration amplitude Vw is made equal to β·s. In this formula, coefficient β>1.

As an example set out in claim 5, the control of "vibration frequency", preferably, is based on equation (6) shown hereunder.

When considering a thermal load occurring in a short time, it is necessary to consider the moving speed ω [μm/sec]. This invention assumes a moving speed ω due to vibration to be 2·Vw·Vf [μm/sec], and the control of "vibration frequency", preferably, is based on the following equation (6):

$$Vf=/(2\cdot Vw)=\omega\cdot s/(2\cdot\alpha\cdot Sv\cdot Sa) \quad (6)$$

There is experimental data that temperature becomes 2,500° C. or less to provide a long life when a rotational frequency is such as to move the electron-colliding portion at 2 m/sec, for example. Based on this data, moving speed $\omega=2\times10^6$ μm/sec. is considered sufficient. However, it is desirable to change the moving speed appropriately according to the heat conductivity K, load, life and so on of the target. A sine wave or triangular wave is used as a drive voltage waveform for vibration.

A supplementary description, about major differences from the rotating anode type noted in problem 6, is following.

The greatest difference between the rotating anode type and the vibration type of this invention lies in the track length of the electron beam. The rotating anode type uses a bearing or the like, and therefore requires a disk target larger than the outer shape of the bearing. For example, even where the bearing has a minimum outer shape of 10 mm, the target diameter is required to be about 11 mm. In this case, with the length of a track described by the electron beam being 31.4 mm, the material being aluminum (density=2.7 g/cm$^3$), and the thickness being 0.5 mm, the target is as heavy as 0.47 g. When the diameter of electron collision is about 1 μm as illustrated in this invention, a vibration amplitude of about 10 μm is sufficient. The holder 11 have a size not exceeding 1×1 mm. The weight in this size is only 0.0014 g. Thus, the invention achieves compactness, lightweight, and small driving power. The feature of little waste of the target material is also desirable from the viewpoint of resources and environment.

Examples of the vibration unit 23 in the above embodiment is described in detail hereinafter by successively referring to FIGS. 10 through 19.

These examples include components said in claims 6-16 of this invention, which demonstrate characteristic effects in this invention. However, this invention is easily implemented with other mechanisms.

As set out in claim 6, a piezoelectric device is particularly suitable for the vibration device contained in the claim 1.

The piezoelectric device is used as an actuator by the property of a piezoelectric material. A piezoelectric material applied an electric field by electrodes is expanded and contracted corresponding to the electric field direction and the polarization direction of the material. Materials for the piezoelectric device include polymers (e.g. copolymer of polyvinylidene fluoride and trifluoroethylene) and ceramics (e.g. having lead zirconate titanate [Pb(Zr,Ti)O$^3$] as a main ingredient). The characteristics of the piezoelectric actuator is the followings:

1. high precision controllability of micro displacement, 2. generating strong stress, 3. excellent high-speed response, 4. high energy conversion efficiency, and 5. no electromagnetic field occurring. As an actuator used in an increasing wide range of application, piezoelectric devices are used for precision control of micro displacement in particular, including precision positioning in semiconductor device manufacturing apparatus and STMs, adjustment of position, angle and focal length of mirrors and lenses of cell-controlling micro manipulators or other optical equipment, and correction of errors in machine tools. Piezoelectric devices are used also as ultrasonic transmitter and receiver elements. The displacement is varied from several nanometers to several hundred micrometers, and response frequency from 0 Hz to several MHz.

Piezoelectric actuators are classified into two types, i.e. the linear displacement type that utilizes in-plane displacements and the curved displacement type that utilizes out-of-plane displacements.

Furthermore, the linear displacement type includes the single plate type and laminate type. The single plate type, in many cases, is a piezoelectric plate polarized in the direction of thickness, for using elastic displacements produced in the lateral direction by applying an electric field parallel to the polarization P. Three types of piezoelectric deformations are produced, which are "vertical deformation", "lateral deformation" and "slip deformation". The laminate type is integrated with stacked piezoelectric plates and electrodes, and each plate has a direction of reversed polarization from that of an adjacent plate. The laminate piezoelectric plates are electrically driven parallel to one another to produce a displacement in a direction of lamination.

The curved displacement type includes a monomorph, unimorph, bimorph and multimorph. The bimorph has two piezoelectric plates on both sides of a shim (thin metal plate) and is bended by applying an opposite electric field to the pair plate. These have simple structures and a large displacement, but generate a weak force.

These piezoelectric devices displacements are generated by closed electric fields between electrodes, and there is no magnetic field as distinct from electromagnetic motors and the like. Thus, it is easy to shield an electric field so that piezoelectric devices prevent adverse influence on an electron beam, and the device can be disposed close to the electron beam.

Even a small piezoelectric device generates a strong driving force enough to vibrate the weight of a holder with ease. The vibration applying mechanism containing a piezoelectric device is small and can be mounted easily in the bore 7 with a diameter of 10 mm or less. Where, as in claim 13, the vibration applying mechanism is preferably mounted in the bore 7, the target is disposed at a minimum distance to the electron lens. Since the aberration at a point of electron convergence is as small as close to the electron lens, a minimum diameter of electron convergence is obtained, also the X-ray focus is minimized. Furthermore, the small vibration unit allows the X-ray focus and inspection object to be close each other, to increase photographic magnification, thereby to obtain X-ray fluoroscopic images of high spatial resolution. Further, with the micron-scale, high precision control and high speed features, a piezoelectric device is the best suited to the vibration applying device of this invention.

Figure 10B:
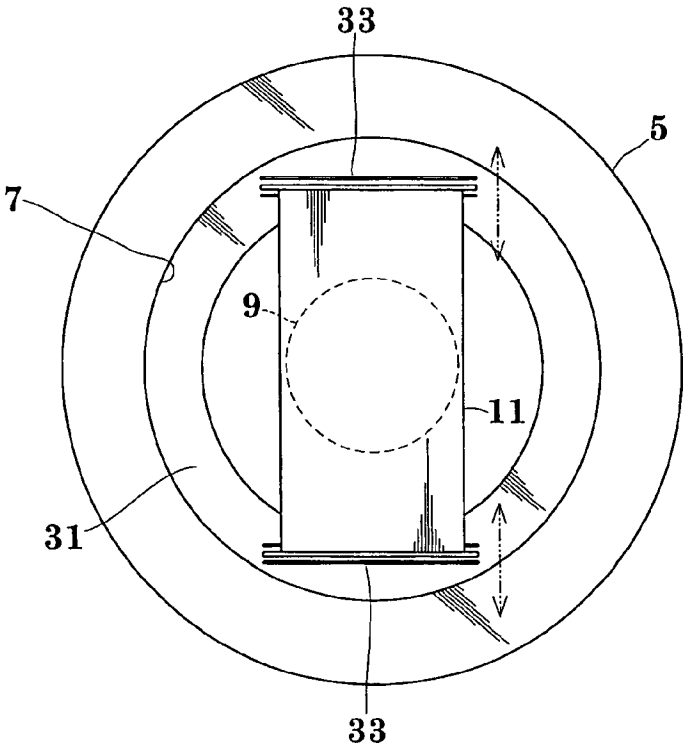
FIG. 10B is a front view.
Figure 10A:
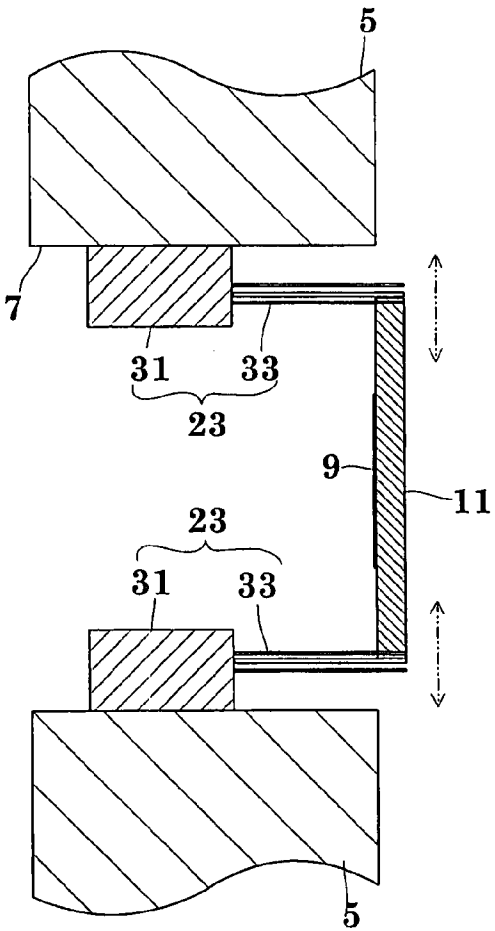
FIG. 10A is a cross section.

An example of vibration unit 23 using bimorphs among the above piezoelectric devices is described with reference to FIG. 10. FIG. 10A shows a cross section and FIG. 10B shows a front view.

The vibration unit 23 shown in FIG. 10 includes a fitting 31 and piezoelectric bimorphs 33. The fitting 31 is cylindrical, and is attached to the peripheral surface of the bore 7 of the end block 5. The piezoelectric bimorphs 33 are in plate form and extend from two, upper and lower positions of the fitting 31. The holder 11 forms a parallelogram attached at upper and lower ends thereof to distal ends of the bimorphs 33. These piezoelectric bimorphs 33 are arranged to bend in the same direction, and an alternating voltage is applied to each. Then, as indicated by two-dot chain line arrows, these piezoelectric bimorphs 33 swing and the target 9 is vibrated in directions parallel to the surface, this vibration realizes a long life and high intensity X-ray tube.

However, since the holder 11 forms a parallelogram, the target 9 is subject to shift in directions along the beam. Where, for example, the piezoelectric bimorphs 33 are 5 mm long and the vibrating amplitude is only 10 μm, the shape of piezoelectric bimorphs 33 is considered to be unchanged and substantially straight. A maximum shift in the direction of incidence of electron beam B is calculated at $5-\sqrt{(5^2-0.01^2)}=10$ nm. However, even when the target 9 is shifted to this extent, the vibration is sufficiently precise for the electron beam B having a normal X-ray focal size of about 1 μm.

Even with a focal size of about 0.1 μm as an example of smaller size, a sufficiently precise vibration is achieved by adopting a vibrating amplitude of 1 μm, in this case a maximum shift is calculated at $5-\sqrt{(5^2-0.001^2)}=0.1$ nm. A ratio of the shift to the focal size in each case is 10 μm/1 μm=10 times, or 1 μm/100 nm=10 times. A large actual area of electron collision is secured on the target 9 to disperse the generated heat, thereby to suppress a local temperature rise on the target surface due to the electron collision.

Figure 11B:
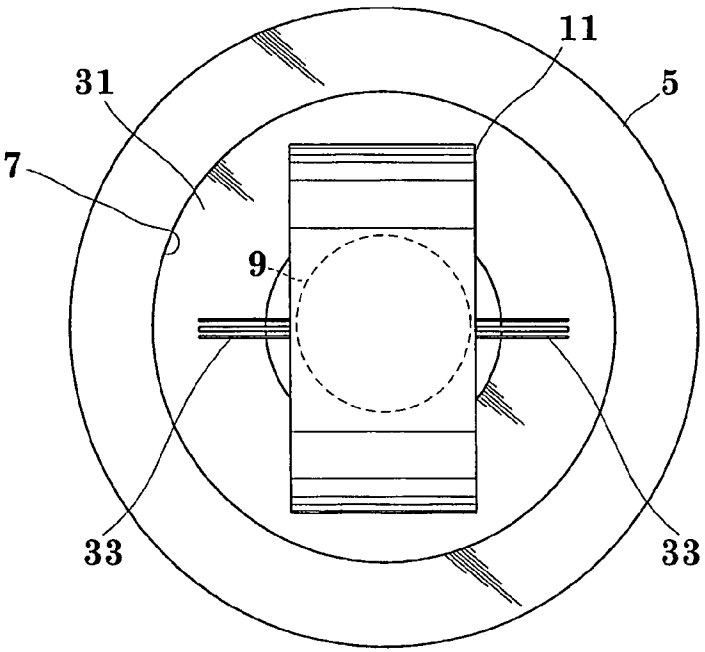
FIG. 11B is a front view.
Figure 11A:
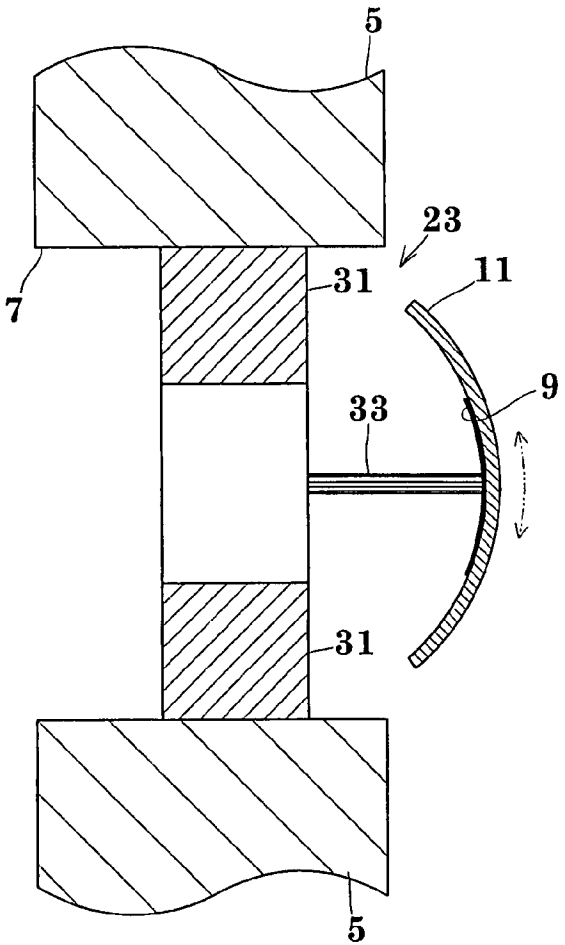
FIG. 11A is a cross section.

Another example of vibration unit 23 using bimorphs is described with reference to FIG. 11. FIG. 11A shows a cross section. FIG. 11B shows a front view. The track of the electron beam is schematically shown in FIG. 6.

In this example, vibration is applied so that, as shown in FIG. 6, the collision spot describes an arcuate track in side view.

As in the construction described above, the vibration unit 23 includes a fitting 31 and two piezoelectric bimorphs 33. The fitting 31 is cylindrical, and is attached to the peripheral surface of the bore 7 of the end block 5. The piezoelectric bimorphs 33 are in plate form and extend from right and left positions at the same height of the fitting 31. The holder 11 has an arcuate section, and attached in vertically middle, right and left positions thereof to distal ends of the bimorphs 33. These piezoelectric bimorphs 33 are arranged to bend in the same direction, and an same alternating voltage is applied to each. Then, as indicated by a two-dot chain line arrow, these piezoelectric bimorphs 33 swing and the holder 11 is vibrated in arcuate orbit whereby the target 9 is vibrated in an arcuate orbit. In addition, the center of the arc of the holder 11 coincides with positions in which the piezoelectric bimorphs 33 are fixed to the fitting 31. Furthermore, the arc of the holder 11 has a radius corresponding to the length of piezoelectric bimorphs 33. Since the center of the arc lies on the optical axis of the electron beam, the vibration does not shift the target in directions along the beam.

Figure 12B:
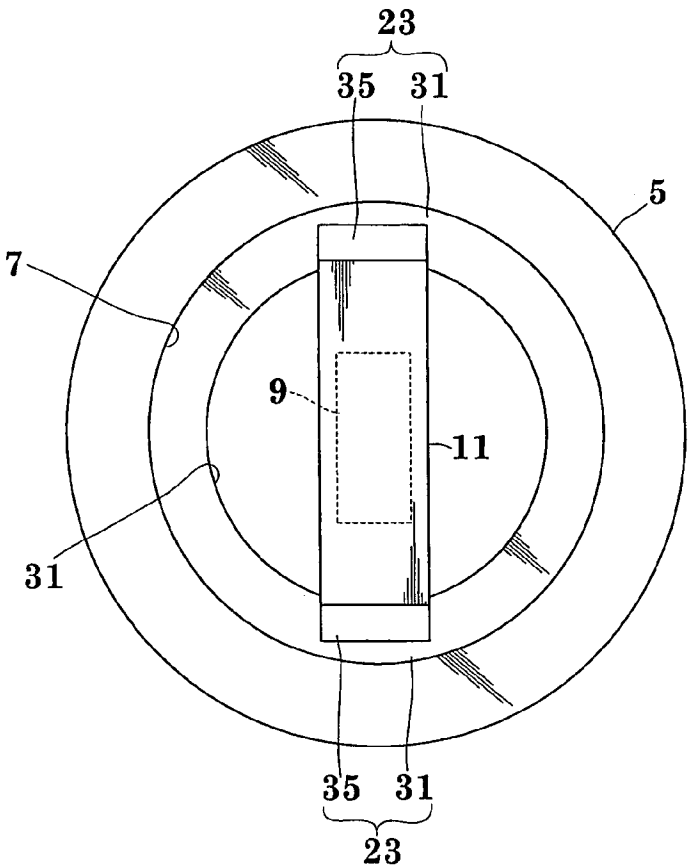
FIG. 12B is a front view.
Figure 12A:
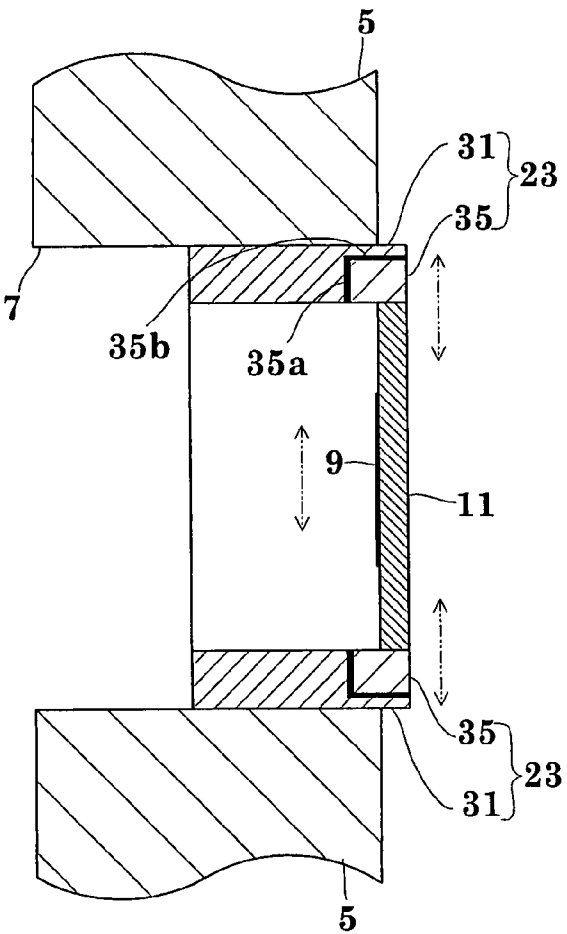
FIG. 12A is a cross section.
Figure 13B:
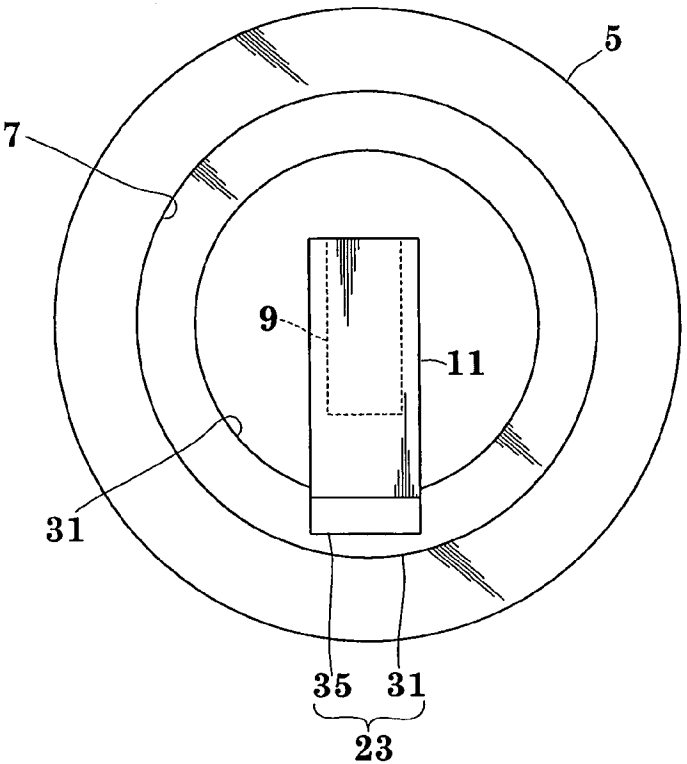
FIG. 13B is a front view.
Figure 13A:
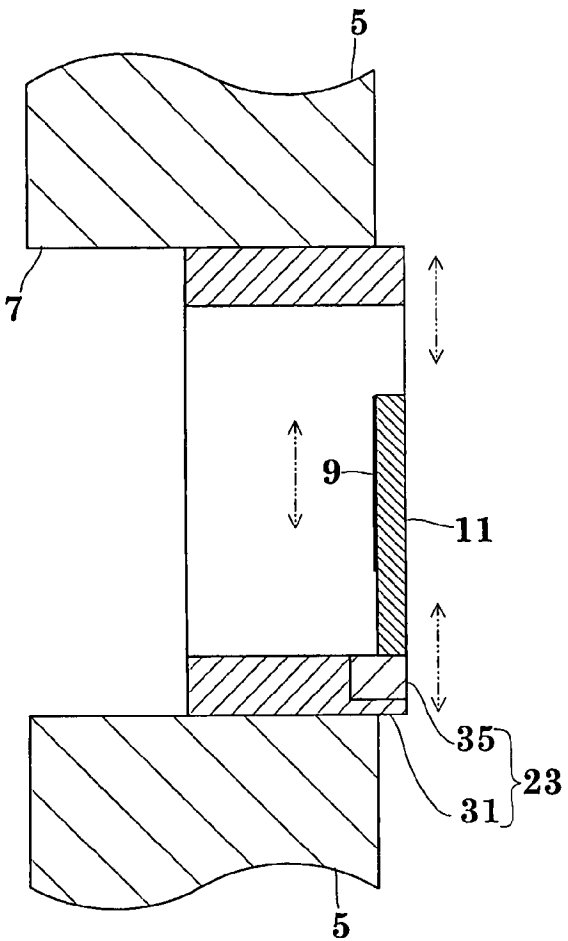
FIG. 13A is a cross section.

Further examples of vibration unit 23 are described with reference to FIGS. 12 and 13. FIGS. 12A and 13A show cross sections. FIGS. 12B and 13B show front views.

These examples comprise piezoelectric devices 35 of the linear displacement type instead of piezoelectric bimorphs 33 described above.

The vibration unit 23 includes a fitting 31 and piezoelectric devices 35. The fitting 31 is cylindrical, and is attached to the peripheral surface of the bore 7 of the end block 5. The piezoelectric devices 35 are prism-shaped and embedded in two, upper and lower inner peripheral positions of the fitting 31. The holder 11 is plate-shaped and is attached at upper and lower ends thereof to inner walls of the piezoelectric devices 35. The two piezoelectric devices 35 are embedded to move minutely in the same direction together parallel to the surface of the target 9. When the piezoelectric devices 35 are driven, vibration is applied to the target 9 parallel to the surface thereof as indicated by two-dot chain line arrows. The piezoelectric devices 35 that undergo lateral deformation or slip deformation are embedded in the fitting 31, and those that undergo vertical deformation are embedded at reference numeral 35*b*. Further, these piezoelectric devices will be the single plate type or laminate type.

In the example shown in FIG. 12, it is unnecessary to consider a shift in the direction of incidence of electron beam B as is necessary with the piezoelectric bimorphs 33 in FIG. 10. Since the direction of displacement is determined only by the characteristic of the piezoelectric devices 35, vibrations is applied with increased precision.

As shown in FIG. 13, even a cantilever mode assures vibrations with sufficiently high precision, in reason that the holder 11 is lightweight.

That is, this example provides only the lower one of the piezoelectric devices 35 embedded in the two, upper and lower positions of the fitting 31 in the preceding example. This produces the same effect as above while simplifying the construction.

Figure 14B:
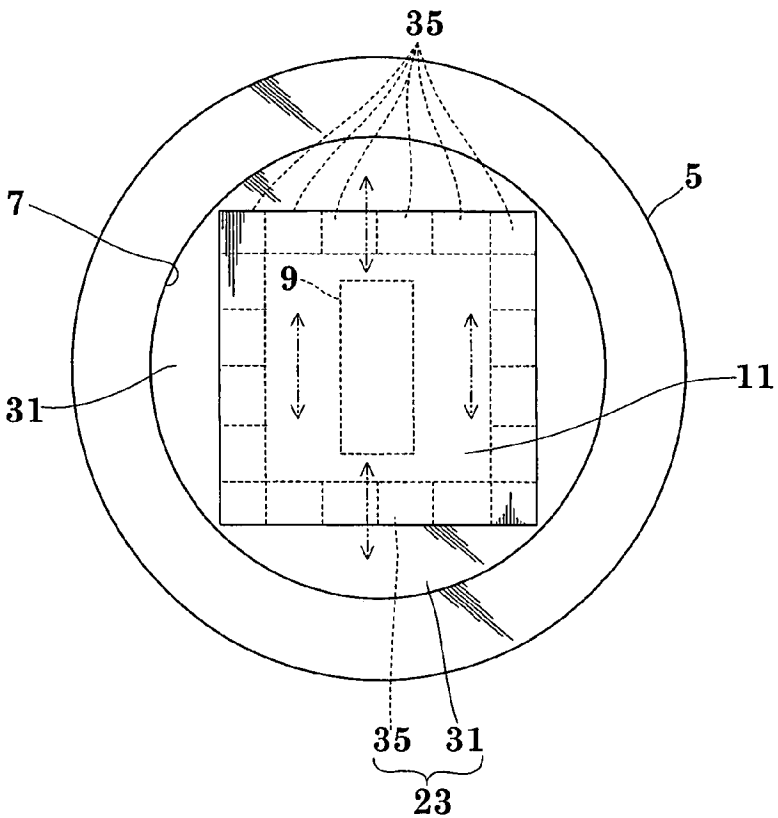
FIG. 14B is a front view.

Next, two examples of vibration unit 23 relating to claim 7 is described with reference to FIGS. 14 and 15. FIGS. 14A and 15A show in section view. FIGS. 14B and 15B show front views.

Figure 14A:
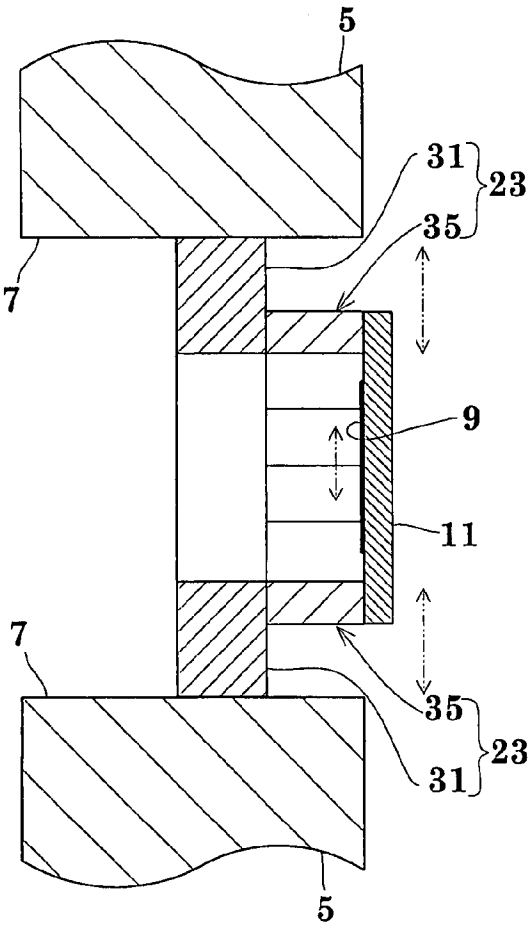
FIG. 14A is a cross section.
Figure 15B:
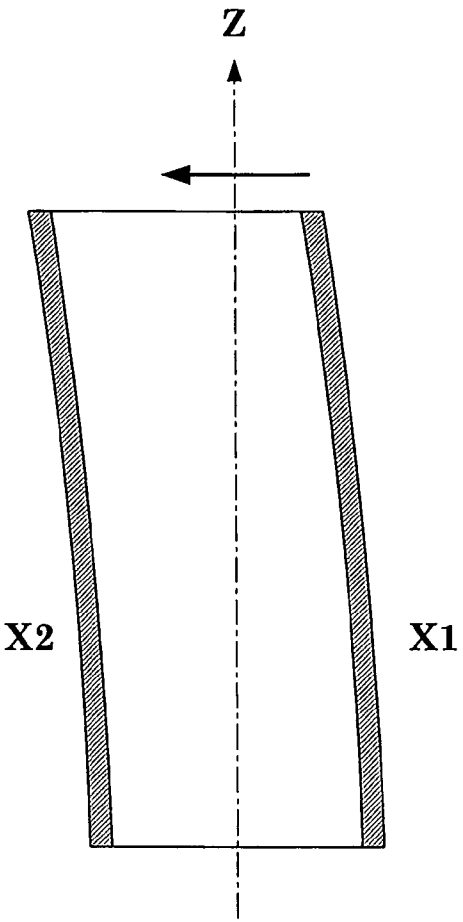
FIG. 15B is a cross section showing one mode of operation.
Figure 15A:
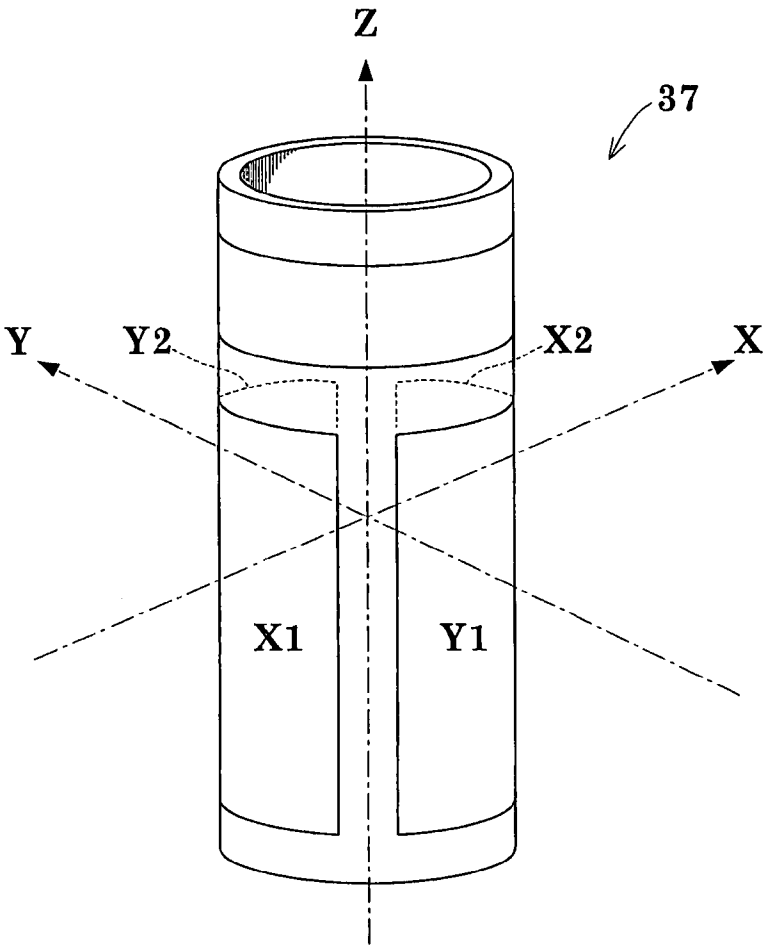
FIG. 15A is a perspective view.

The example shown in FIG. 14 is integrated together a plurality of linear displacement type piezoelectric devices 35 of about 1 mm square and several millimeters in height and attached to a fitting 31 to have a square outer shape and compose a hollow space inside. The holder 11 is attached to the piezoelectric devices 35 so as to close the hollow space. Each piezoelectric device 35 is operable to make a "slip deformation", and vibrate in directions parallel to the surface of the target 9 (vertically in FIG. 14A).

According to this construction, the piezoelectric devices 35 and holder 11 are integrated to form a closed space. Consequently, the vacuum window 13 shown in FIG. 2 is no longer necessary. This simple construction, allows the X-ray focus and inspection object to be close together to realize increased photographic magnification. Thus, the apparatus has a high resolution performance.

Although, in the above construction, a plurality of piezoelectric devices 35 are used, a piezoelectric device 37 having a special cylindrical shape is used as shown in FIG. 15.

This piezoelectric device 37 is manufactured by sintermolding a ferroelectric material, to have a cylindrical shape with an outside diameter of about 5 mm and a length of about 5-20 mm. The piezoelectric device 37 is operable three-dimensionally. An example in which such a piezoelectric device 37 is applied is a three-dimensional scanner for a scanning probe microscope. The piezoelectric device 37 has a grounding electrode mounted on an inner peripheral surface thereof, and five electrodes X1, X2, Y1, Y2 and Z arranged on an outer peripheral surface. The electrodes X1 and X2 are opposed to each other along an X-axis extending perpendicular to the cylinder axis. The electrodes Y1 and Y2 are opposed to each other along a Y-axis. The electrode Z is disposed annularly on an upper outer peripheral surface around a Z-axis extending along the cylinder axis.

This piezoelectric device 37 is extendible when a positive voltage is applied, and contractible when a negative voltage is applied, to the electrodes disposed on the outer peripheral surface opposite the grounding electrode. The piezoelectric device 37 is attached to the fitting 31. When the portion including the electrodes X1, X2, Y1 and Y2 is attached to the fitting 31 and when a voltage of opposite polarities is applied to the electrodes X1 and X2 opposed to each other, the piezoelectric device 37 operates as shown in FIG. 15B. That is, the portion of electrode X1 extends while the portion of electrode X2 contracts, whereby the whole device 37 bends to displace the portion of electrode Z in the X direction.

An amount of displacement at the distal end is determined by the cylinder length and the voltage applied. A scan signal applied is provided for scans from 1 nm to several tens of micrometers by a voltage of several volts to 200V.

By bonding the holder 11 to the top of this piezoelectric device 37, the same effect is produced as the construction shown in FIG. 14. Moreover, since the target can be moved in the Z direction, also interlocking the piezoelectric device and the electron lens move the X-ray focus position. This provides an advantage of a fine adjustment of photographic magnification without moving a inspection object. Applying a voltage to the electrode Z cause a very minute extension or contraction in the order of 10 nm/V in the Z direction.

As set out in claim 8, the vibration unit of this invention preferably contains some flexures as support elements thereof. Where minute displacements of 1 mm or less is required in this invention, flexures is the plastic deformation element that is free from slips, static friction, kinetic friction and back crash under the severe environments. Flexures have various kinds, which are called a spring, a coil spring, spring plate and other. These flexures are the best suited support parts for this invention under a high vacuum, high temperature and high speed, because lubricant (grease) is unnecessary like the steel ball bearing. Flexures have a further advantage of being small, simple, low cost and highly precise.

Figure 16B:
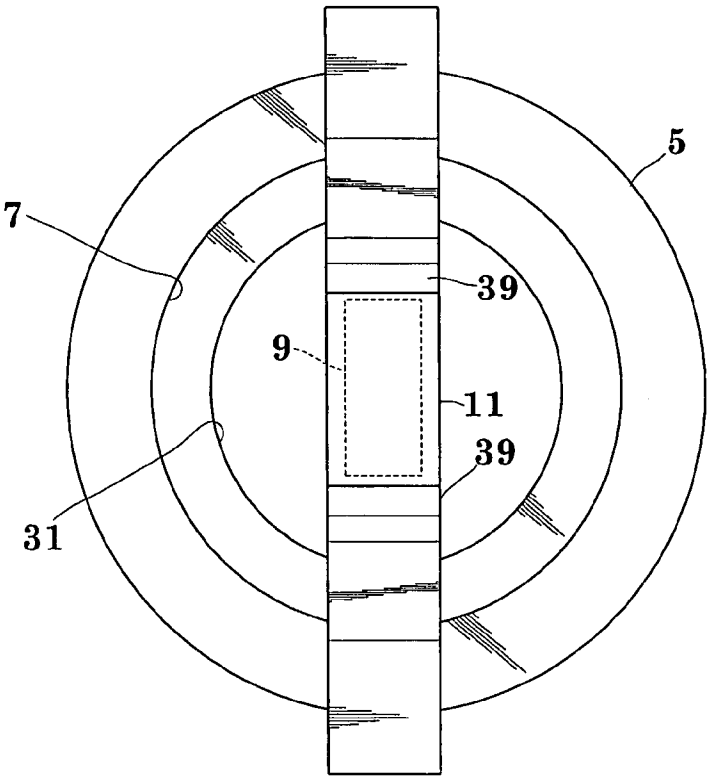
FIG. 16B is a front view.
Figure 16A:
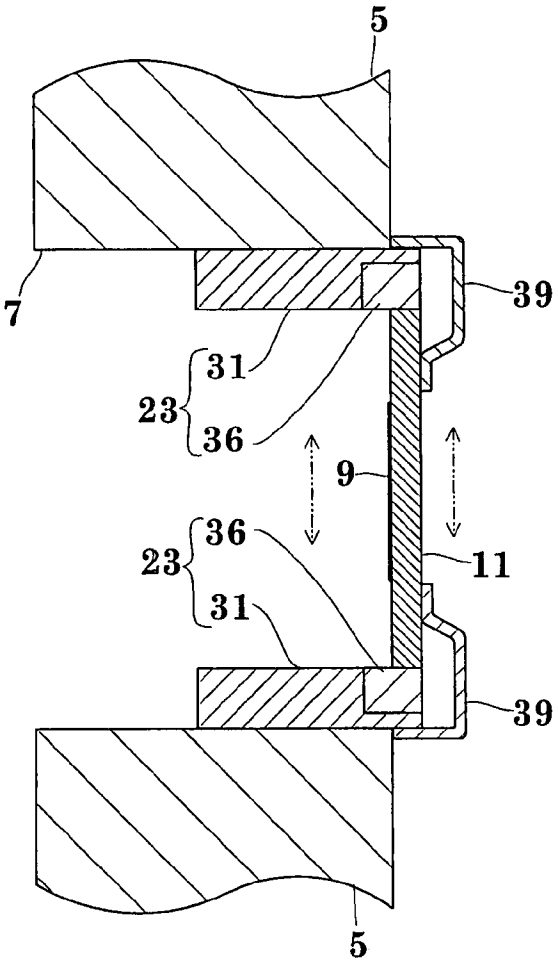
FIG. 16A is a cross section.
Figure 17:
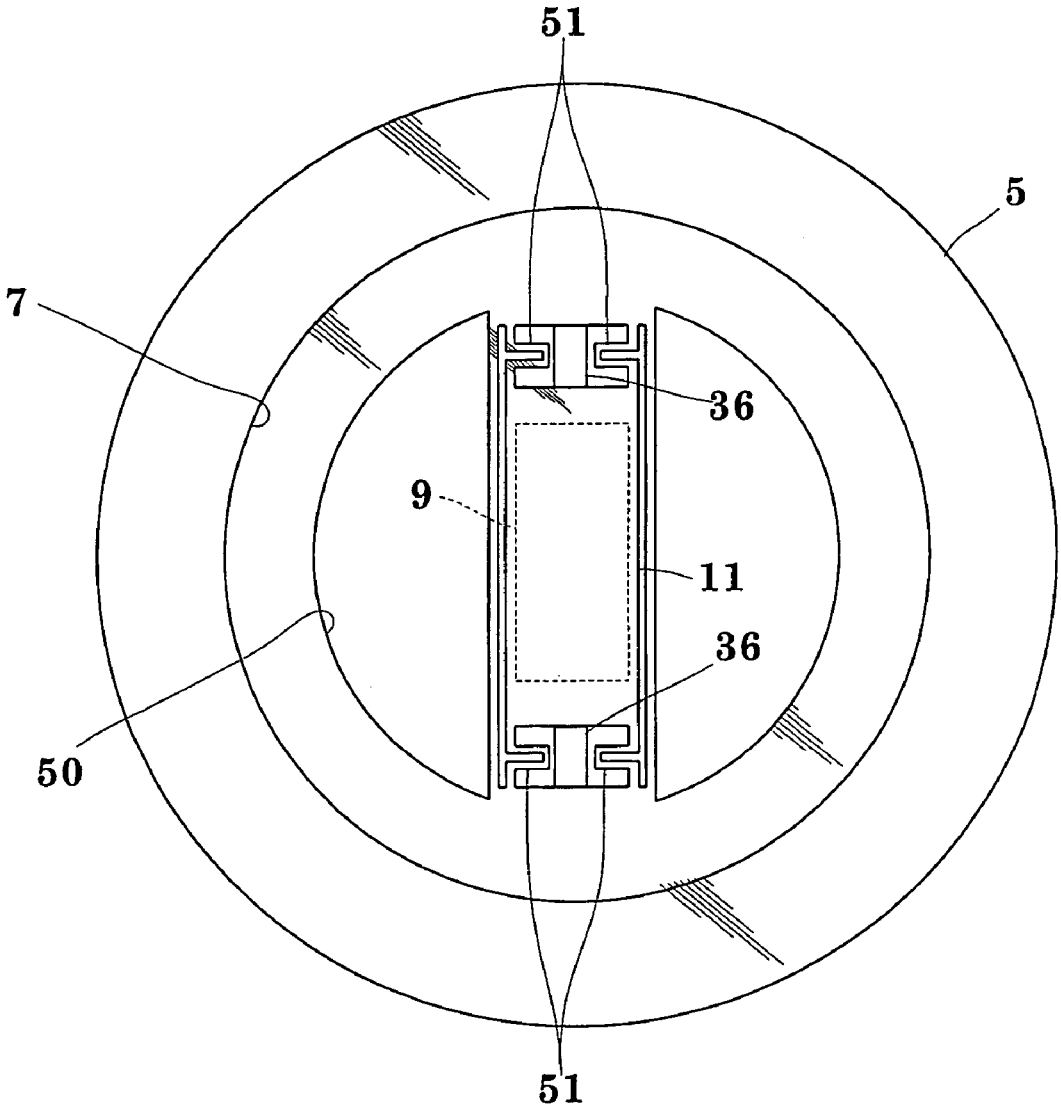
FIG. 17 is a front view showing an outline construction using flexures manufactured by electrical discharge machining.
Figure 18:
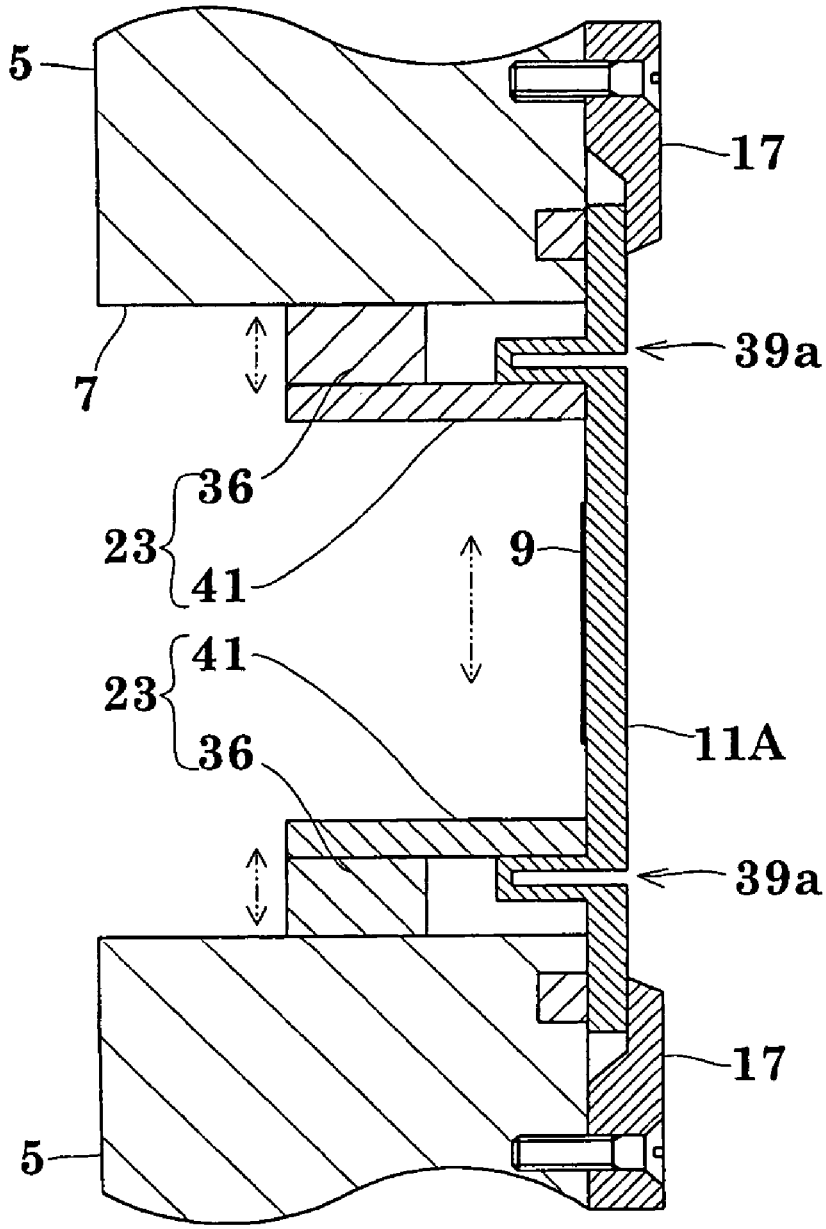
FIG. 18 is a cross section showing an outline construction using flexures.

Examples using flexures is described in order, referring to FIGS. 16 through 18. FIG. 16A shows a cross section. FIG. 16B shows a front view. FIG. 17 shows a front view. FIG. 18 shows a cross section.

The construction shown in FIG. 16 is similar to the construction shown in FIG. 12. The difference is that the flexures 39 is attached between the fitting 31 and the holder 11. The portion, flexures 39 and holder 11, flexures 39 and fitting 31, is joined by adhesive or welding that preferably provide high heat conductivity.

The material for flexures 39, preferably, is ceramic or metal from the viewpoint of heat conductivity, and further preferably, phosphor bronze or beryllium copper which is a material for springs, from the viewpoint of durability. Furthermore, it is desirable to cut off flexures 39 from a thick metal plate by electrical discharge machining from the viewpoint of processing accuracy (claim 9).

The flexures 39 release the heat of the target 9 through the holder 11, and suppress a deflection of the target 9 in directions along the electron beam. Thus, a vibration deviation of the X-ray focus is suppressed.

Of course, the flexures 39 will be attached on the other mechanism; FIGS. 10 through 15, contained the piezoelectric devices.

FIG. 17 shows a construction similar to FIG. 16. The difference is that the flexures 39 and fitting 31 are replaced here with the fitting 50 integrated flexure portions 51; U-shaped hinge. The holder 11 of the target 9 will be connected by a thermally conductive adhesive or welding. However, FIG. 17 shows an integrated mold including the holder 11.

As set out in claim 14, the flexure portions 51 are thin in the direction of vibration of the target 9 and thick in the direction perpendicular to the direction of vibration. These flexure portions 51 characterized by high aspect ratio will be formed by electrical discharge machining, for example. Another shapes are conceivable, such as a simple plate or radial shapes. Such flexures of high aspect ratio is driven by a small force in the direction of vibration, but are difficult to move in the direction perpendicular to the direction of vibration. Thus, the flexures enable highly precise vibrations of the target 9 without deflection in directions along the electron beam. The flexures are suitable for a element of a vibration applying mechanism of an X-ray tube having a submicron X-ray focus of several microns or less. The integrated mold formation is desirable also from a viewpoint of assembling accuracy.

FIG. 18 is a cross section showing a different construction of the vibration unit 23 using flexures.

A vacuum window (13) acts also as a holder 11A, and has flexures 39*a* formed peripherally thereof. Drive devices 36 are connected to the holder 11A through connecting plates 41. The holder 11A is cut from a cylindrical metal block by electrical discharge machining, for example. The holder 11A will be formed identically with the connecting plates 41.

Since vibration is applied to the target 9 through the holder 11, the target 9 is vacuum-sealed by the flexures 39*a* capable of absorbing vibration. Thus, the vacuum window (13) of FIG. 2 is dispensed with, to minimize a distance between the X-ray focus and inspection object, and geometrically increase resolution. The portions of flexures 39*a* will be formed of elastic elements, such as rubber elements or bellows (claim 10).

Next, the construction set out in claim 11 is described.

Improvement regarding problem 5: "Unnecessary absorption of X-rays by the target is eliminated by thinning the target."

As described in Problem 5 hereinbefore, the conventional target is thick and unnecessarily absorbs X-rays. In this invention, vibrating causes an extended life even to the thin target, and therefore a transmitting X-ray dose increases.

For example, electrons with an energy of 40 keV accelerated in time of 40 kV tube voltage collide with the tungsten target, and penetrate a maximum depth of 2.6 μm to the target. Since the target has an extended life in this invention, the target have a thickness corresponding to the maximum electron penetration depth of 2.6 μm. This eliminates the 20% X-ray absorption by the 2.4 μm tungsten conventionally added as an extra. Thus, the target according to this invention has 1.2 times the working throughput of the conventional 5 μm target. The effect is particularly outstanding at low energy X-ray with a large proportion of absorption.

When electrons accelerated by E[kV] collide with a target of density ρ[g/cm$^3$], a maximum electron penetrating depth R[μm] is derived from the following equation (4):

$$R=0.0021\ (E^2/\rho) \tag{4}$$

A target thickness for maximizing X-ray generation corresponds to the maximum penetrate depth R in time of acceleration voltage E[kV]. Thus, the optimum target thickness is adopted from the equation (4).

Although the target thickness is not necessarily limited to R, generally, this invention effect is expected roughly within twice R. This is well suited particularly where easily absorbable soft X-rays are generated.

When a collision diameter s [μm] is less than the micron scale and an accreting voltage is over around 40 keV, a target thickness t [μm] substantially corresponding to the collision diameter s is desirable from the viewpoint of a minute X-ray focal size (claim 15).

Next, the construction set out in claim 12 is described.

When the electron beam power is low, the vibration controller 25 displaces the target as follows.

When the electron beam power is low, the vibration unit preferably displaces the target at every several months or several weeks, for example, to change positions of the electron collision spot. In this case, vibration may or may not be applied to the target in each position. Such displacement move the colliding spot of electron beam B to a different positions in few seconds, and dispenses with evacuating times as required with the fixed type. The quick changing avoids deterioration in working throughput or time.

This invention is not limited to the foregoing embodiments and will be modified as follows or more:

(1) The drive element of the vibration unit 23 is an electrostriction device, an electrostatic actuator, or a magnetostrictive device. Further, an electromagnetic motor or a solenoid will be utilizable, when these are disposed remote from the electron beam, or with a magnetic shield inserted. Such a construction provides a significant advantage of extending life, but although not attaining compactness or high resolution.

(2) The flexures of the vibration unit 23 will be replaced with wire springs, metal gauzes, slip bearings, ceramic ball bearings, elastic metal elements, for example.

Figure 19:
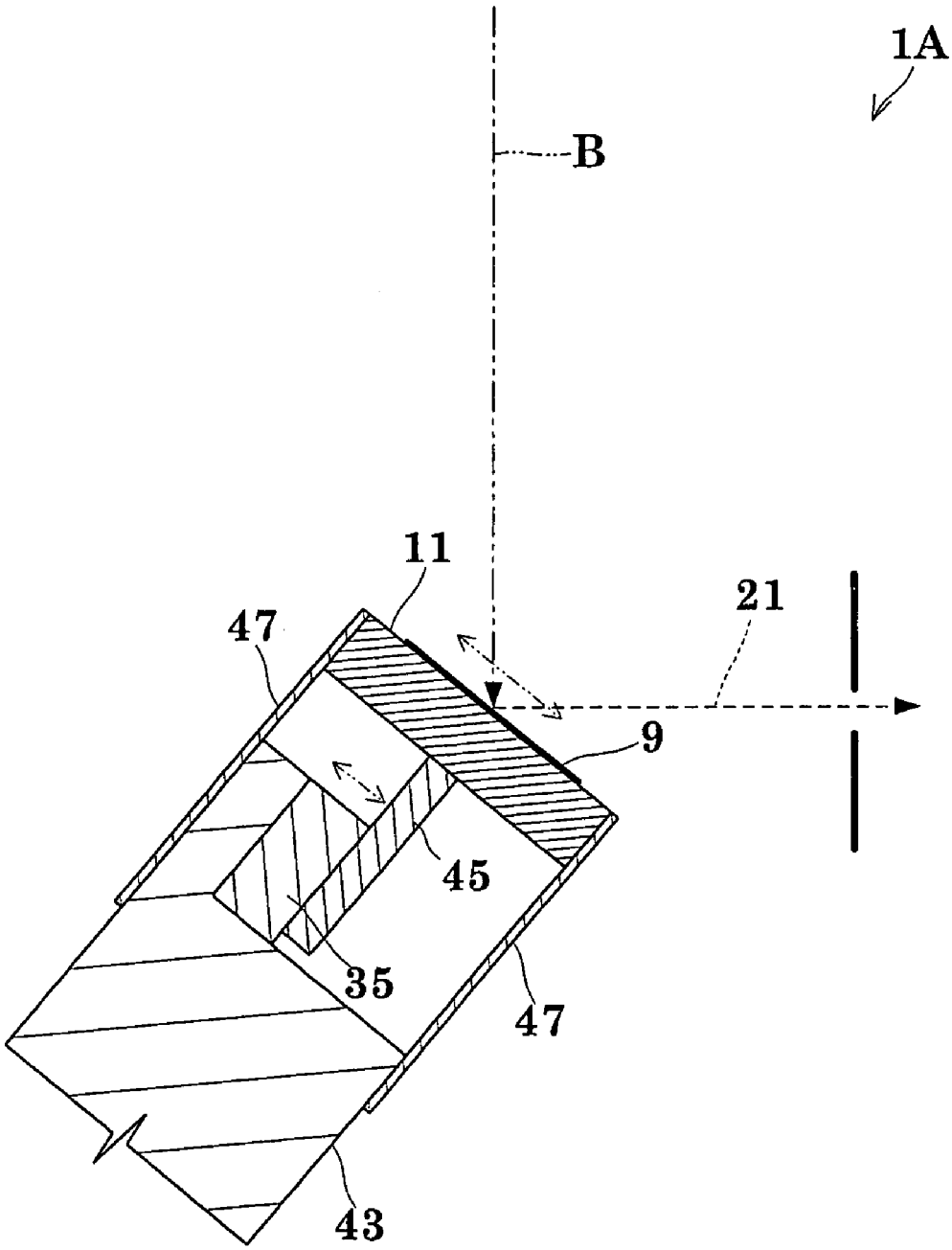
FIG. 19 is a cross section showing an outline of a reflection X-ray generating apparatus.

(3) All the examples described above relate to a transmission X-ray generating apparatus 1. This invention is applicable also to a reflection X-ray generating apparatus. FIG. 19 is a cross section showing a target and adjacent components of a reflection X-ray generating apparatus 1A.

This reflection X-ray generating apparatus 1A according to this invention includes a support base 43 for locating a holder 11 having a target 9 at an angle to a direction of electron beam B. The support base 43 has a coupling rod 45 attached to a center forward position thereof through a piezoelectric device 35. The holder 11 is attached to the forward end of the coupling rod 45. Flexible connecting plates 47 interconnect side surfaces of the holder 11 and side surfaces of the support base 43.

When driven, the piezoelectric device 35 applies vibration to the target 9 in directions parallel to the surface thereof. Thus, with such a reflection X-ray generating apparatus 1A, as with the transmission X-ray generating apparatus 1, the invention produces a similar thermal effect to realize a long life and high X-ray intensity (claim 16).

INDUSTRIAL UTILITY

As described above, this invention is suited for an X-ray generating apparatus with high resolution and compactness, for extending the life of a target, increasing the operating ratio of the apparatus, extending a time of continuously generating X-rays, and improving X-ray intensity, which are achieved by vibrating the target and enlarging an effective electron-colliding area.

The invention claimed is:

1. An apparatus for generating X-rays by irradiating a target with an electron beam, comprising:

an electron gun operative for emitting electrons;

an electron lens having a bore extending therethrough for receiving and converging the emitted electrons;

vibration applying means for vibrating said target in directions parallel to a surface thereof, the vibration applying means disposed within the bore and connected to the electron lens;

a holder connected to the vibration applying means and operative to hold the target within or adjacent the bore; and a vacuum vessel operative for containing the electron gun, the electron lens, the vibration applying means and the target in a vacuum.

2. An apparatus as defined in claim 1, wherein said vibration applying means includes a piezoelectric device.

3. An apparatus as defined in claim 1, wherein said vibration applying means is arranged to vibrate said target so that said electron beam has a colliding spot describing, on said target, one of a linear track, a circular track, and a two-dimensional shape including zigzag and rectangular shapes.

4. An apparatus as defined in claim 1, further comprising a vibration controller for controlling said vibration applying means based on one of a voltage, a current, an electron beam diameter, and a temperature measured adjacent a spot of electron beam collision.

5. An apparatus as defined in claim 4, wherein said vibration controller is arranged to control a magnitude of vibration amplitude, the magnitude of the vibration amplitude being more than the electron beam diameter.

6. An apparatus as defined in claim 4, wherein said vibration controller is arranged to make the vibration frequency variable.

7. An apparatus as defined in claim 2, wherein said piezoelectric device is integrated with said holder having said target to define a closed space.

8. An apparatus as defined in claim 7, further comprising flexures for attaching and supporting said holder.

9. An apparatus as defined in claim 8, wherein said flexures are made by electrical discharge machining.

10. An apparatus as defined in claim 1, further comprising rubber elements or flexures to provide a vacuum seal.

11. An apparatus as defined in claim 1, wherein said target has a thickness up to twice the depth of electrons penetration calculated from a voltage and said target material.

12. An apparatus as defined in claim 1, wherein said vibration applying means is arranged to displace said target.

13. An apparatus as defined in claim 1, wherein said vibration applying means is disposed in a bore in which said target is located.

14. An apparatus as defined in claim 8, wherein said flexures are shaped thin in a direction of vibration of said target, and thick in a direction perpendicular to the direction of vibration.

15. An apparatus as defined in claim 1, wherein said target has a thickness corresponding to a diameter of said electron beam colliding with said target.

16. An apparatus as defined in claim 1, wherein said target is disposed at an angle to said electron beam.

* * * * *